United States Patent [19]

Aoki et al.

[11] Patent Number: 4,769,661

[45] Date of Patent: Sep. 6, 1988

[54] DISK FILM DEVELOPING METHOD AND APPARATUS

[75] Inventors: Syozo Aoki, Hino; Shigeharu Koboshi, Sagamihara; Masayuki Kurematsu; Masahiko Kon, both of Hino, all of Japan

[73] Assignee: Konishiroku Photo Industry, Co., Ltd., Tokyo, Japan

[21] Appl. No.: 947,521

[22] Filed: Dec. 29, 1986

[30] Foreign Application Priority Data

Dec. 30, 1985 [JP] Japan ..... 60-297847
Feb. 3, 1986 [JP] Japan ..... 61-21858
Feb. 4, 1986 [JP] Japan ..... 61-23333

[51] Int. Cl.[4] ..... G03D 3/02; G03D 3/08

[52] U.S. Cl. ..... 354/322; 354/323; 354/324; 354/330

[58] Field of Search ..... 354/316, 317, 318, 320, 354/322, 323, 324, 329, 330

[56] References Cited

U.S. PATENT DOCUMENTS 4,112,454 9/1978 Harvey ..... 354/330
4,142,193 2/1979 Otte et al. ..... 354/323
4,167,320 9/1979 Hutchinson ..... 354/330
4,188,106 2/1980 Harvey ..... 354/330
4,265,525 5/1981 Stella et al. ..... 354/86
4,429,980 2/1984 Miller ..... 354/330
4,497,559 2/1985 Maris et al. ..... 354/316
4,569,578 2/1986 Stella et al. ..... 354/86

*Primary Examiner*—A. A. Mathews
*Attorney, Agent, or Firm*—Finnegan, Henderson, Farabow, Garrett and Dunner

[57] ABSTRACT

The main object of the invention is to provide a disk film developing apparatus which has a developing process section of non-light shielding construction having substantially no darkroom section and in which one or more disk films are developed while being accomodated in a cartridge.

The photographic processing apparatus for the disk film according to the invention comprises a means for holding the cartridge containing the disk film therein, a means for supplying a processing solution into the cartridge, and a means for releasing the disk film from the cartridge. And, during the photographic processing, the disk film being contained in the cartridge can be rotated by a rotating means.

21 Claims, 10 Drawing Sheets

FIG. 27-a
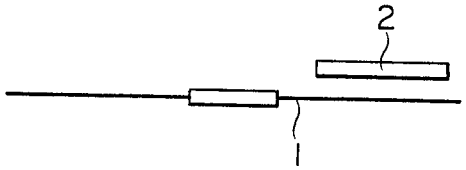
FIG. 27-b
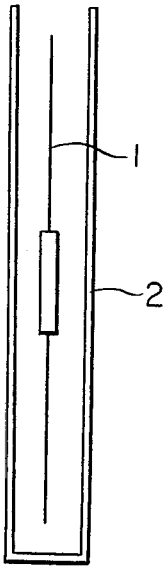
FIG. 27-c
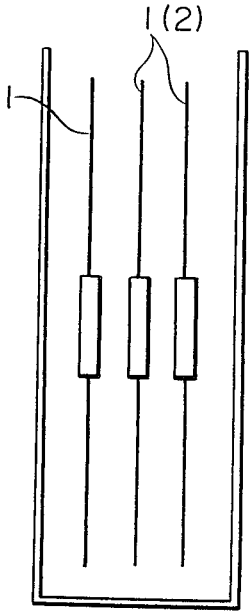
FIG. 28
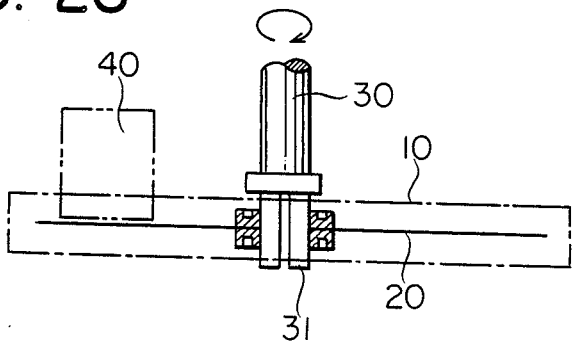

DISK FILM DEVELOPING METHOD AND APPARATUS

BACKGROUND OF THE INVENTION

This invention relates to a method of developing a photographic material shaped in a disk form (hereafter called as a disk film) or an apparatus therefor. More particularly, it is related to a disk film developing apparatus used in a novel photographic treatment system which makes it possible to view a photographed picture quickly by print or viewer after photographing. It can be installed in a small space in a camera shops, D.P.E. agencies, film retail shops, etc. and permits development of good photographic performance by simple operation. This permits anyone who has no photograph processing knowledge to operate it and to use in the home.

It is a desire cherished by anyone to see the photograph quickly after photographing. So-called instant photographs invented by polaroid Company of Cambridge Mass. fulfill this need. Recently, an electronic type of photography (e.g. the electronic still camera of Sony® Corporation) using a magnetic recording medium without using photograph film was introduced.

The former, however, is expensive in unit cost and is unsuitable to obtaining a plurality of copies and the latter is, at present, unsatisfactory in photographic performance such as sensitivity and resolving power. In addition, the apparatus is expensive and the equipment is larger than the disk camera taken up here. It cannot provide hard copies having high resolving power and high sharpness, which is unlike the silver-halide photography.

Further, a self-developing film and a photograph treating kit which attains developing process by means of injecting a photograph processing solution into the magazine accommodating a roll film are known, but the former is a special one quite different from the ordinary photographic film, and the latter is for the "photograph mania", not accessible to a layman who has little knowledge of photography. It is not suitable to the novel photograph system aimed at by this invention.

Accordingly, it is an object of the present invention to provide a novel photograph processing system which makes it possible to view a photographed picture by print or viewer quickly after photographing by use of a disk film according to the invention.

The disk film is supplied in the form of a film unit accommodated in a cartridge. After exposure in a specified camera, it is taken to a centralized photograph processing facility, a so called "lab", through agencies, and subjected to photographic processing such as developing and printing.

In the lab., disk film is taken out of the cartridge by a cartridge opener, set on an automatic developer, and automatically developed while being rotated at a high speed.

In the photographic processing technique for disk film, many prior art references for processing roll film are utilized, but those pertaining to the disk film are, for example:

Related to disk-film camera
U.S. Pat. No. 4,202,614
Japanese Patent Publication Open to Public Inspection No. 113,526/1978 (hereinafter referred to as Japanese Patent O.P.I. Publication)

Japanese Patent O.P.I. Publication No. 146437/1980
Japanese Patent O.P.I. Publication No. 146438/1980
Related to disk film and film unit
U.S. Pat. Nos. 4,212,673
4,264,169
Japanese Patent O.P.I. Publication Nos. 113,525/1978
101,940/1980
101,942/1980
Related to disk-film photograph processing
U.S. Pat. Nos. 4,112,453
4,132,469
4,188,106
4,208,116
4,248,564
Japanese Patent O.P.I. Publication No. 110829/1978
Related to disk-film printing
U.S. Pat. Nos. 4,203,664
4,204,773
Related to general matter
Those described in the Whole Aspect of Kodak Disk Film (Photograph Industry, p. 26–41, April, 1982) are available.

The disk film, like other amateur photographic film prepared for amateur use such as 35-mm roll film, is protected from light being accommodated in a light-shielding vessel (hereinafter called cartridge), and installed in a specified camera being kept in the cartridge, when photographing. The specified camera opens the shutter of the exposure window of the cartridge to make photographing possible, linking with the operation of the installation of the cartridge and film windup. After photographing, the shutter of the cartridge exposure window is closed linked with the operation or the cartridge being taken out, and the disk film is again protected in the cartridge from light.

The developing process for such a disk film as described above, taking out the disk film from the cartridge, color developing, bleaching, fixing (or bleaching fixing), and washing (or stabilizing) are performed substantially as a darkroom, like in the case of roll film.

The conventional developing apparatus has an advantage that it can treat a multiplicity of disk film at a time, but the consumers of the disk film in Japan is no more than 2–3% of the consumers of amateur photograph film (mainly 35-mm roll film) and the request for developing the disk film to a camera shop is as small as zero to several cassettes per one day, thus, the centralized treatment by the lab. is made inevitable as mentioned above. This situation may not conform to the recent needs of the consumers remarkably observed in 35-mm roll film for shorter treating time (waiting time) from reception of developing request to delivery in a shop such as one day, several hours, or one hour.

Such developing apparatus which can process a multiplicity of disk roll at a time has larger processing tank than one being required and is further provided with a replenishing solution tank, replenishing equipment for the replenishing solution and piping for water washing treatment and a waste solution tank, thereby further becoming too large. In addition to the problem in size, the operation for above developing apparatus is complicated and requires a certain level of special knowledge including that is necessary to deal with troubles in the dark room. These demerits are an obstacle to the provision of the apparatus in a camera shop for developing service, accordingly, this fact is against the current needs of shortening the processing (waiting) time.

Such response of the photograph processing equipment maker against the flow toward mini-lab. for 35-mm roll film which makes the shop front service possible by non-washing, non-piping, table size, and short-time processing (within one hour) offsets the merits of simple operation, easy handling, compactness, and easy editing of exposed film processed by disk film or camera in contrast to 35-mm roll film or camera, resulting in obstructing the spreading of disk film.

Recently, with the spread of electronics equipment such as video, merely viewing prints as before is not satisfactory and it is desired earnestly to view large pictures together with great numbers of peoples such as family. The rapid advance of recent electronics equipment has made electronic reading of color picture information of developed film possible, and its display on every type of viewer not only on television screen are also possible. In addition, easy practice of enlargement and modulation of color tone made it possible to view the film, which has been photographed by oneself, in the best or most favorable conditions.

Thus, one advantage of the electronics equipment is that the picture is directly obtained from the film without intermediate operation of the printing. In comparison with the simultaneous print system so far, the developing process is reduced by half as the printing process is unnecessary. This brings it one step closer to the proper desire to see the picture earlier as it has been photographed. As such, the requirements for reducing developing (wait) time increase, then even requirements for shop-front service or domestic processing arise. It is obvious in such a case that the processing apparatus now on sale at the market cannot cope with the problem. For such purposes, processing capacity of no more than 1 to 2 disk films at a time may be sufficient. The size of the processing apparatus should be as small as possible (such as desk-top type), and the operation should be more simple than as described above (one-button operation or no darkroom operation may be better).

The problems to be solved by the invention as studied by the inventors are as follows:

A. Quick Processing

Similarly to the case of roll film, the DPE (photographic process) of disk films is centralized in a lab. Therefore, the finish requires usually one or two or more days from the request to the agency.

In a lab., since a large number of disk films are automatically processed, it is actually difficult to process routinely a specified small number of disk films more quickly.

In addition, the position of a lab. is unevenly distributed. Should the photograph processing be made in a lab., it is impossible to satisfy the demand to make any photograph visible quickly after photographing. To satisfy such demand, it is desirable to make photograph processing possible to be carried out in a familiar position such as a camera shop, D.P.E. agency, and film retail shop, rather than a lab, or domestic processing facility.

B. Miniaturization and Simplification of Apparatus

To make installation of the apparatus in a small space such as in an ordinary camera shop, it is desirable to further miniaturize the apparatus.

C. Light Room Processing

In consideration of the space and costs for installing a new darkroom in a position having no dark room facilities, except the camera shops, etc., which have been processing photographs, it is desirable to make photograph processing possible under a light room or simple light shielding facilities.

Also, in an automatic developing apparatus so far, the photographic processing tank including the film conveying system has a darkroom construction (up to washing tank in automatic developing apparatus of disk film, up to bleaching tank for color negative film) which makes the construction complex or large-sized, and when a trouble has occurred in the darkroom section, it is difficult to make out the position of failure and the repair is troublesome since the dark room can not be opened.

When domestic film processing is intended without making a request to a lab., uneasiness may be felt if the disk film or cartridge under processing is not visible.

D. Compensation of Photographic Property and Automation therefore

In Photographic processing, uncertainty of photographic quality is apt to occur depending upon the developing process conditions such as temperature and time, accordingly considerable skill is required, but the arrangement of experts is limited, and the operation is complex. Therefore, it is desirable to attain uniform and good development by simple operation not requiring a skill, by automating at least essential parts of photographic processing.

As mentioned above, a kit is known which gives developing process to a roll film together with the magazine, but this cannot be used for disk film treatment.

E. Reducing the Quantity of Processing Solution

In the automatic developing apparatus so far, the processing solution are overflown from the processing tank by the supply of new processing solution. In consideration of the delivery of the processing solutions to and disposal of waste solution (overflow solution) from the agencies which may be expected to lie scattered in various positions, it is desired to carry out photographic processing with using small quantities of processing solution and washing water.

In the conventional large-sized automatic developing apparatus, the contents of processing solution consumed, dissolved and concentrated by the processing are regenerated by replenishing with the replenisher. Thus, the activity of the developer can be varied depending upon the conditions of continuous processing, which may cause a difference in finish depending upon the lab. or season. However, by use of a small quantity of always adjusted new processing solution, stable finish can be expected.

Further, the reduced quantity of processing solution permits easy adjustment of temperature with smaller energy consumption. It allows unprecedented temperature control so that the temperature of the processing solution can be changed during processing.

SUMMARY OF THE INVENTION

The main object of the invention is to solve the above problems, and particularly, to provide a disk film developing apparatus which as a developing process section of non-light-shielding construction having substantially no darkroom section and in which one or more disk films are developed while being accommodated in a cartridge.

The photographic processing apparatus for the disk film according to the invention comprises a means for holding a cartridge containing the disk film therein, a means for supplying a processing solution into the cartridge, and a means for releasing the disk film from the cartridge.

And, during the photographic processing, the disk film being contained in the cartridge can be rotated by a rotating means.

BRIEF DESCRIPTION OF THE DRAWINGS

FIG. 28 is a sectional view showing a disk film being contained in a cartridge.

DETAILED DESCRIPTION OF THE INVENTION

Figure 1:
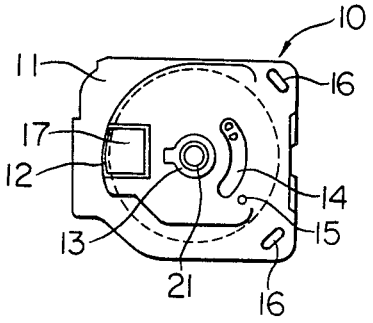
FIG. 1 is a plan view showing a disk film cartridge used in the invention.

The present invention for attaining the above objects is now described in detail with reference to a preferred embodiment.

In this embodiment, a developer not having any part substantially shielded from light holds a cartridge accommodating exposed disk film and processes the film as accommodated in the cartridge.

Unless otherwise specified, the cartridge used in the invention includes both the conventional disk film cartridge and the one which has been modified to facilitate the use in the processing system of the invention.

The cartridge can be held by pressing its top and bottom faces or from the sides. Or may be held by the attraction of reduced air pressure in which the suction port is pressed down on top or bottom faces of the cartridge. Or, the holding may be attained by only mounting on a recess formed on the stand. Or, also may be attained by pressing both the faces of the core of the disk film and held together with the cartridge.

The holding condition of the cartridge may be horizontal, vertical, or inclined.

The method of holding the cartridge is related to the means for breaking cartridge, method of processing photograph including the method of supplying the processing solution, rotation mechanism of disk film, and temperature control means, and is applicable in various manner.

The mechanism up to the processor holds the cartridge may be allowed to be any one as required and any known method can be used therefore. Preferably, the processing apparatus has a cartridge introducing port, and a cartridge introduced through the port is sent to the cartridge holding section by a guide rail or other conveying means and is held in the section.

Or, it may be permissible to set directly the cartridge into the cartridge holding section by hand without using the above conveying means and so on, this means may be a matter of choice.

It is prefer that the disk film is relatively rotated to the cartridge during developing process.

To perform above rotation, the poor processing treatment caused by the uneven contact with the processing solution may be avoided, accordingly, the high quality image can be obtained without any unevenness.

The rotation improves the processing capacity, remarkably reducing the treating time and improving the fineness of grain in the developed image picture.

As the mechanism for rotating the disk film, it is preferable to provide a rotating shaft capable of being driven by a motor through either one of direct connection or transmitting mechanism and engage it with the hub of disk film to rotate it.

The relative rotation of the disk film is preferable for above purposes. To attain this relative rotation, the disk film is rotated while keeping the cartridge being stationary by either way of fixing outside of it with a fixing means such as a stopper or setting it into the recess shaped a predetermined form in the base plate and so on, or on the contrary, the cartridge is rotated while keeping the disk film being stationary not to rotate.

To feed the photographic processing solution onto the disk film may be attained by various methods such as immersion, injection, dropping, application, and spraying. These methods can be selected in accordance with the processing system of which one system utilize the cartridge as a processing tank without using an external tank and another system uses an external (auxiliary) processing tank.

To supply the processing solution, there are some methods, for example, using the openings of the cartridge such as exposure window or the operating section of the light shielding plate, or newly providing an opening for supplying processing solution in place of above openings.

Further, it may be allowed that leakage of the supplied solution may be prevented by sealing the edges of the cartridge with tape, etc. The cartridge holding means may also serve as the leakage preventing means for the processing solution.

For immersing the cartridge into the processing liquid in the processing tank, holding the cartridge vertically is more useful for making the apparatus more compact than holding it horizontally, since the bottom area of the tank can be made smaller. In this case, for example, the cartridge may be immersed to a point a little higher than the exposure window into the solution and the disk film may be turned. This permits the supply of processing solution all over the disk film, and is useful for reducing the required quantity of processing solution.

In an apparatus which holds the cartridge horizontally, for example, plural cartridges are horizontally attached to a driving shaft, a quantity corresponding to the number of the cartridges attached may be enough for the quantity of processing solution to be supplied. This is effective for changing-over between one-piece treatment and plural pieces treatment.

Conveying the cartridges in photograph processing, that is, moving the held cartridges (or conversely, moving the processing tank while fixing the cartridges) to up-and-down direction, horizontally, or in circumferential direction can be effected by various known means.

The formation and arrangement of the photographic processing tanks freely arranged as a matter of design choice. Three or four processing tanks, consisting of such as CD tank for color developing, BF tank for bleach fixing, (or BL tank, FIX tank), Sb tank for stabilizing (or washing tank) are arranged linearly, in series, in parallel, or annularly, as requires.

It is also preferable to process photograph by supplying the processing solutions one by one without moving the cartridge.

In a method which injects processing solution into the cartridge without using a processing tank, or in a method which uses an auxiliary tank, a cartridge conveying mechanism is not needed and the process can be performed on the condition of the cartridge fixed in a specified position.

In such a system, the processing solution can be replaced by the manner that the following process solution is poured into the prior process solution so as to discharge the prior solution. Thus, this system is preferable since no special method or apparatus is required. A method which injects the following solution after expelling the prior solution by a cleaning means such as applying pressure with compressed air is also preferable. This method can reduce the quantity of processing solution to be used, since it does not cause activity of following solution to lower due to mixing with prior solution.

These processing solutions may be dispensed from a conventional type vessel containing a large quantity of processing solution in a quantity as required for processing one sheet of disk film or two or more sheets. It is preferable to supply these processing solutions as a kit by cassette or bag containing a quantity required for one sheet of disk film per every processing solution.

Preferably, these cassettes, etc. are so composed to be the one capable of being directly mounted on the processing apparatus. Further, in the processing apparatus, it is preferable that selected processing solution (cassette) is directly supplied on the disk film surface or the solution is supplied in the processing tank.

The processing apparatus is preferably provided with a temperature control means to keep processing temperature within stable range: In this temperature control means, the type, configuration, installation position, exothermic capacity, and the method of heat conduction of the heater are not limited. However, the following points are regarded as a preferable embodiments.

The processing solution, which has a high specific heat and coefficient of heat transfer lower than metallic holder, is preferably preheated and prepared to keep the preheated temperature. Since the temperature of the processing solution during processing is apt to be governed by the temperature of the cartridge and disk film, it is preferable to control the temperature of these items and their peripheral space and members before or during processing.

These operations can be carried out further stably and effectively by reducing the quantity of processing solution. In these operations, by setting the processing temperature higher in the initial stage of color developing and lower in the latter stage, to make the grain size of the picture finer becomes possible.

It is preferable that the processing apparatus is provided with a drying means. In the system which dries the disk film after taking it away from the cartridge, natural drying may be used.

To dry the disk film without taking out of the cartridge, for example, it is preferable to send dry air into the cartridge to push out the remaining processing solution and then to dry it. Since the disk film remains in the cartridge, this method is convenient for putting the disk film in order. By providing on the label side plate a new opening of the size corresponding to the exposure window on the exposure window side plate, the disk film can be printed or applied to video in that state.

However, to attain effective drying and quick processing it is preferable to release the film from the cartridge by breaking it before drying.

For breaking the cartridge, any method can be used unless the disk film is impaired. A breaking means on sale at the market may be used, or it may be broken by hand.

When the cartridge was broken before drying, it is preferable to rotate the film in the drying process. By the rotation, the drops on the surface can be shaken down, and then the drying is accelerated. It is also preferable to blow dry air against the film surface. It is further preferable to blow dry air against the film surface while rotating the film. The drying time is remarkably reduced.

When the conventional cartridge of disk film is used, it is preferable that the cartridge is broken after CD (color development). The safety sense given by processing the disk film without using the darkroom is the largest in this case. That is, when the disk film becomes visible by breaking the cartridge, as the process proceeds, the picture appears on the film surface gradually and distinctly.

When the cartridge is released, it is also preferable to use one side of the cartridge as the processing tank.

After being dried, disk film is preferably automatically delivered from the processing apparatus as accommodated in a cartridge or taken out from the cartridge. It may also be delivered out by manual operation.

Various automatic discharge devices are available as a delivery means, but it is preferable to compose such device so as to release its holding mechanism for cartridge or disk film after the end of processing and discharge the cartridge or disk film on the guide rail or guide plate and then deliver them toward outside.

It is preferable that the processing apparatus is provided with a waste solution disposal means. Since the quantity of the processing solution used in this invention is small, the waste solution of the processing solution can be absorbed in a solution absorbing material such as solution absorbing resin and packed with the absorbing material by a non-immersing material such as vinyl sheet and then threw away. In this case, it is better that a deodorant material such as active carbon can preferably be mixed with them to absorb smelly components. It is also preferable to decrease the quantity of the waste solution by concentrating or converting into dry solid by evaporating the liquid contained in the waste solution through either way of blowing hot exhaust air from the processing apparatus onto the waste solution or using a heating means provided separately.

Thus, preferable embodiments of the invention have been described. These can be combined in any manner, and the invention is not limited in the form described.

[EXAMPLE]

An embodiment of a device according to the present invention will now be described in detail in reference to the accompanying diagrams.

In FIG. 27-*a*, numeral 1 denotes a disc film, and numeral 2 a drag member or a resistive member. Both the disc film and the drag member may be immersed into photographic processing solution, or, the photographic solution may be introduced between the emulsion side of the disc film 1 and the drag member 2.

The clearance between the disc film 1 and the drag member 2 ranges from 0 mm, where both are in contact with each other, to several mm, or, preferably, less than 10 mm.

The drag member 2 is disposed so as to cover the whole area or part of the emulsion surface of the disc film 2. The shape of member may be whichever a bar, sheet or others, and the material of it may be arbitrarily selected from softer to harder ones. Additionally, there is no limitation on the number of the drag members to be disposed.

The typical examples of the drag member 2 are a dark slide or the like accommodated within a cartridge of a disc film unit, and a rubbing member such as a roller, sponge or the like.

Furthermore, as shown in FIG. 27-*b*, such a drag member may be a wall of a processing tank where a singularity of disc film 1 is treated, or, as shown in FIG. 27-*c*, the other disc films 1 (2) may work as the similar members when a plurality of disc film 1 are simultaneously treated. In the former case, if the width of the processing tank is greater, independent drag members may be incorporated. In the latter case, the directions of rotation of neighboring disc films 1 are preferably reverse with each other, or, the different rotating speed may be provided for each disc film 1, or, actuation involving such steps revolution/halt/revolution or/reversing the direction of rotation may be exercised.

If a plurality of disc film are treated, as shown in FIG. 27-*c*, drag members may be additionally provided among disc films.

Next, a embodiment of a device according to the present invention will now be further described in detail in reference to the accompanying diagrams.

The present invention is not to be understood as limited by the embodiments thereof shown in the diagrams. Said embodiments represent examples thereof and the details thereof may be rearranged by other devices shown in the diagrams and the design thereof may be changed to other constructions having similar functions which are not shown in the diagrams.

Prior to explanations of the embodiment according to the present invention, the disc film and the cartridge to which the present invention is applied will hereafter be described.

Figure 2:
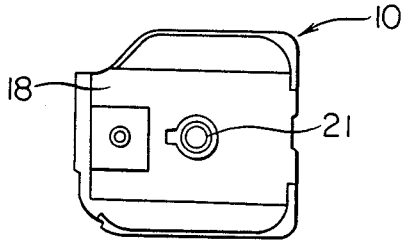
FIG. 2 is a bottom view showing the disk film cartridge shown in FIG. 1.
Figure 3:
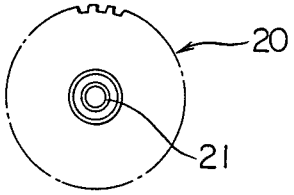
FIG. 3 is a plan view showing a plan view showing a disk film according to the invention.

FIGS. 1 through 3 illustrate disc film units which are being placed on sale. In the diagrams, 10 represents a cartridge, and FIG. 1 is a top view illustrating the cartridge as viewed from the aperture side for exposure, FIG. 2 a bottom view illustrating the label side and FIG. 3 a top view of the disc film 20 as seen from the emulsion side thereof.

On the aperture side 11 are provided an exposure aperture 12, a center aperture 13, a curved slot 14 (or a dark slide drive slot) along which the dark slide is moved, a dark slide unlock hole 15, and an aperture 16 which is used to break the cartridge.

Inside the exposure aperture 12 is a dark slide which is arranged concentrically with the disc film 20 so that the disc film 20 will be caused to be exposed at the exposure aperture 12 by inserting the pin into the hole 15 in order to release the locking mechanism and then rotating the dark slide 17 by using a lug of the dark slide 17 exposed in the slot 14 while pressing the pin.

At the center aperture 13 is exposed the hub (central core) of the disc film 20.

In a camera which uses the disc films, a mechanism used to open and close the dark slide and a mechanism to rotate the disc film are incorporated, so that the light exposing or shutting-off operation onto the emulsion side of the disc film by opening or closing the dark slide and the frame feeding operation are carried out and frames thereof are driven by using said apertures.

Exposed disc film units are sent through photograph shops to film processing laboratories, where firstly the cartridge 10 is broken in a dark room using a special cartridge opener and then the disc film is taken out from the cartridge.

To break the cartridge, the pin is inserted through the slot 16 which is used to break the cartridge and provided on the aperture side of the cartridge 10 so as to enable the pin to push out the label side 17, thereby breaking the joined part between the aperture side 11 and the label side 18. In addition to this basic motion to break the cartridge, the end of the cartridge 10 may be cut off or the end of the label side 18 may be pushed or pulled off.

To adopt a new film processing system of the present invention, in an improved disc film unit which contains the disk film in the cartridge to permit loading into a camera for taking pictures and is designed to a disc film while keeping it in the cartridge, it may be preferable to comprise a mechanism used in common to move the dark slide and to drive frames of the disc film 20, a mechanism to load or hold the cartridge in a developer, structures to supply and discharge the film processing solution into and out of the cartridge, and structures to break the cartridge, without changing the external shapes of the cartridge 10 and the disc film 20 to make possible to load the disc film unit in disc cameras of other makers.

In case the disc film unit to be used is not common to the camera of other make, there is no restriction on the related standards and optimum as well as a wide range of structures or mechanisms can be adopted to utilize the new film processing system according to the present invention.

The present invention is characterized in that photographic processing solution is introduced into a cartridge accommodating an exposed disc film, whereby photographic developing process is carried out as the disc film is contained within the cartridge while the disc film is being rotated. FIG. 28 is a schematic diagram of such an arrangement. More specifically, in FIG. 28, numeral 10 denotes a cartridge housing a disc film 20. The detail of the disc film unit is given in FIGS. 1~3. Numeral 30 represents a rotary shaft, whose chuck 31 is engaged into the opening of a hub 21 on the disc film 20, wherein the rotation of the rotary disc 30 rotates the disc film 20 as accommodated in the cartridge 10.

Numeral 40 denotes a means which rubs the emulsion surface of the disc film 20 and is employed in a preferable embodiment of the invention, where a roller, sponge or the like is inserted through an exposure aperture 12 on the cartridge 10 so that it can contact the emulsion surface of the disc film 20 and rub the emulsion surface with the rotation of the disc film 20.

EXAMPLE 1

Color forming developer or developing solution was continuously fed onto an exposed disc film 20 through openings such as an exposure aperture 12, central opening 13 and dark slide drive slot 14 on a cartridge 10. After color developing process was carried out with the rotation of the disc film 20, color developer was discharged from the cartridge 10 through the openings. After bleach-fixing process was exercised by continuously feeding bleach-fixer in the same manner, mentioned above, while rotating the disc film 20, the cartridge 10 was broken so as to take out the disc film 10. The disk film 10 was rinsed with water and then dried.

To eject processing solutions from the cartridge 10, various methods are utilized, wherein free fall, ejection with pressurized fluid, vacuum suction or the like was carried out.

EXAMPLE 2

Though this example was similar to example 1, either color developer or fixer was not continuously fed during each process but fed in such an amount enough to fill the cartridge 10 in order to carry out each process.

EXAMPLE 3

Unlike example 1 where bleach-fixer was fed after discharging color developer from the cartridge 10, in this example, bleach-fixer was fed, without discharging used color developer, so as to carry out bleach-fixing process, following a specific duration of color developing process.

EXAMPLE 4

In this example, stabilization was carried out, instead of water-rinsing, with substitute stabilizing solution for water-rinsing, and, each processing solution was supplied in the same manner as described for examples 1~3. More specifically, after 2 min 30 sec color developing process, 8 min bleach-fixing process, 2 min stabilizing process with substitute stablizing solution 1 and 2 min stabilizing process with stabilizing solution 2, the disc film 20 was removed from the cartridge 10 for drying.

EXAMPLE 5

In this example, developing solution was fed not through the openings the cartridge 10 has but through a newly prepared 1~2 mm dia hole, for example. The provision of a new hole for discharging processing solution was also advantageous. While preventing light from entering the cartridge 10 by providing light-shielding mechanism or means for each opening, each processing solution was fed and discharged. With this example, each process was carried out in the same manner as described for examples 1~4.

EXAMPLE 6

In this example, each processing solution was applied, by coating, drip-feeding, spraying or the like, on the emulsion surface of the disc film 20 which was disclosed at the exposure aperture 12 by opening the dark slide 17, in order to carry out developing process while the disc film 20 was being rotated.

EXAMPLE 7

In this example, each processing solution was poured into a processing tank, and, the disc film 20 as accommodated in the cartridge 10 was immersed into processing solution contained in the processing tank, whereby processing solution was allowed to enter the cartridge 10, and, developing process was carried out while, advantageously, the disc film 20 was being rotated.

APPARATUS EXAMPLE 1

In the present example, a disc film, as it is contained in the cartridge, is developed by an immersion process. In other words, the cartridge is used as a light shielding means (container) during the developing process with is carried out by allowing the developing solution into the cartridge through a clearance or an aperture thereof.

Figure 4:
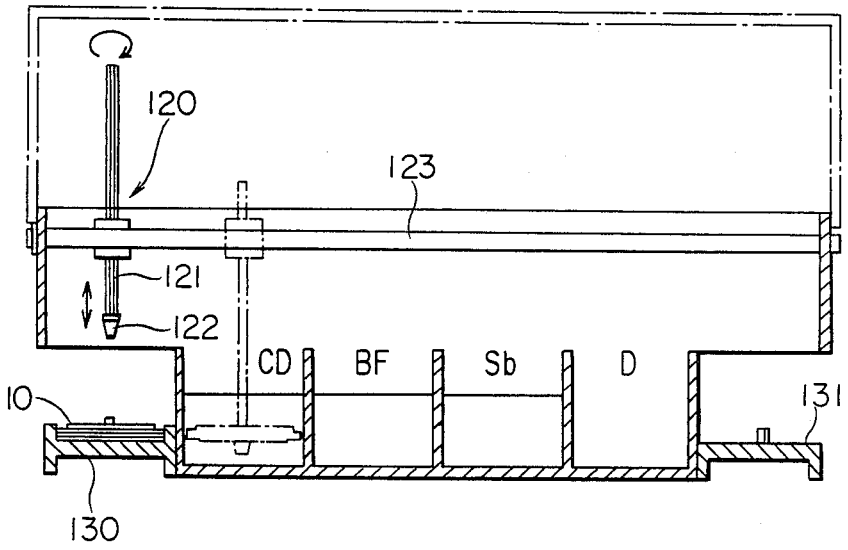
FIGS. 4 to 6, FIGS. 8 to 12, and FIGS. 18 to 20 are schematic sectional views of the developing apparatus according to the invention.

FIG. 4 is used to described the example, wherein 10 is the cartridge of the film unit in which an exposed disc film is contained, and the cartridge containing a film to be developed is first placed on the starting rest 130 and is made ready for developing.

Upon turning on the process start switch, the rod 121 for vertical movement of the transfer system 120 is lowered, the chuck 122 formed on the tip of said rod 121 grips the cartridge 10 using the center aperture thereof, and then said rod 121 is raised with the cartridge 10.

Then the rod 121 moves along the guide rail 123 to the right direction on the diagram and stops at the color developing tank. As the rod 121 is lowered, the disc film (cartridge 10) is immersed into the color developing solution, which in turn permeates into the cartridge through clearances such as the exposure aperture and the center aperture of the cartridge 10, contact with the emulsion side of the disc film and then cause the color development thereof. After certain time has elapsed, the rod 121 which still holds the cartridge 10 now raises again and proceed to the following developing processes such as the bleaching and fixing tank BF, stabilizing tank Sb, and the drying section D, carrying out similar operations.

Upon completing the developing processes of above, the cartridge 10 is conveyed to the finishing rest 131, released from the chuck 122 of the rod 121, and left on the finishing rest 131 or dropped therefrom.

The configuration of the developing tanks illustrated in the diagrams are shown as typical examples and will not be limited to applications as shown. For example, such applications will also include other configurations such as those having a color developing tank CD, a bleaching tank BL, a fixing tank FIX, a stabilizing tank Sb which substitutes for water washing tank, and a secondary stabilizing tank.

In the example illustrated, the drying section D will not necessarily be provided, and in this case, it may arranged that after completing the stabilizing process which substitutes the washing process the cartridge 10 may be broken to take out the disc film for subsequent drying, or the disc film may be dried after having been sent to a drying means provided for each cartridge 10.

As the chucking mechanism having a chuck 122 which transfers the cartridge 10 fixed at the tip of the rod 122 through a transfer system 120 with a starting rest 130 and a finishing rest 131, a disc film supply device as stated in the Laid Open Utility Model #1984-170845 can be used for example.

The chucking mechanism may be replaced with a dish or a net on which the cartridge 10 can be placed for transfer, or with a means which may be used for transfer by gripping part of the cartridge 10, or various other means may be designed in place of the chucking mechanism.

An entire transfer system 120 is not limited to the example shown in the diagram as well, and may be designed in many ways. Processing tanks may be arranged radially thereby moving the rod 121 in the circumferential direction to guide the cartridge 10 into each developing tank or conversely, the rod 121 may be fixed and each developing tank is radially arranged on the turn table thereby moving the developing tanks to the fixed rod 121.

With an object to stabilize the developing processes and to improve sharpness thereof by providing stable shearing force and contact effect of the processing solution with the emulsion side of the disc film, the transfer system shown in the diagram also includes, for example, a mechanism wherein the disc film is caused to rotate in the cartridge 10 by the rod 121 or a rotating rod contained in the rod 121.

In the case of the example of above, the cartridge side may be rotated while the disc film being fixed or both the disc film and the cartridge side may be rotated in opposing directions. It is also preferable to turn them round or to cause the rotational center to be eccentric.

If the rotating speed is too fast, the emulsion side of the disc film may be scratched. Therefore, it is not necessary to rotate the disc film at high speed.

Figure 5:
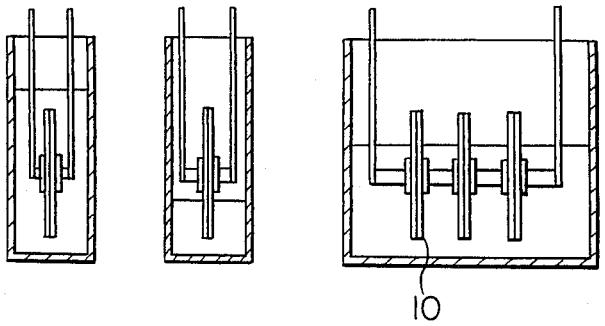

Further, as shown in FIG. 5, one or more cartridge 10 may be suspended and the whole or a part thereof may be caused to be immersed. In the case of such examples, it is necessary to provide a mechanism to rotate the entirety of the cartridge 10 or the disc film.

In the developing device illustrated, since the cartridge 10 has a light shut-off function, the whole or a part of the frame body or the top cover of the each processing tank may be formed with transparent materials or even the top portion thereof may be allowed to be in an opened condition. If the frame body for the top cover is made of opaque materials, the invention includes such body capable of being freely detachable as one example of above embodiment.

Though not shown in the diagram, the concept of the present invention includes the embodiment having a means for breaking a part of the cartridge 10 containing the disk film therein in the color developing tank CD in order to make a supply port for the processing solution. If, in this case, the light enters from said supply port into the cartridge 10, it is necessary to provide a means for shutting off the light at the supply port or to constitute so constructions of tanks as to shut off the light in the color developing tank CD, the bleaching tank BL and the bleaching and fixing tank BF.

APPARATUS EXAMPLE 2

Figure 6:
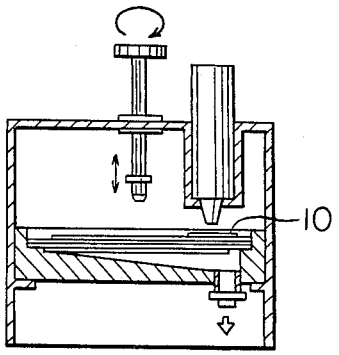

In the automatic developing apparatus shown in FIG. 4 and FIG. 5, the disc film is immersed in the processing solution together with the cartridge 10 for subsequent developing processes. In this example, however, the processing tank is not provided as shown in FIG. 6, wherein the cartridge 10 itself is used as a processing tank, an aperture of the cartridge 10 such as the exposure aperture 12 thereof or an aperture (of light shut-off structure) such as one provided by a special device is used to pour, apply or spray the processing solution, for example, by using a processing solution cassette, over the emulsion side of the disc film thereby carrying out processing photographic. In this case, it is permitted to form the covering member of the apparatus with transparent materials and to have the top portion in released condition.

In the case of this example as well, it is preferable to provide a rotating mechanism for the disc film or the cartridge, such as above mentioned.

APPARATUS EXAMPLE 3

In the example shown in FIG. 6, a concave section is provided at the rest for placing the cartridge 10 and is used as an auxiliary tank to collect the processing fluid.

APPARATUS EXAMPLE 4

This example is a changed version of the example shown in FIG. 6, wherein a mechanism is additionally provided in FIG. 6 which can open and close the dark slide arranged at the exposure aperture of the cartridge 10 by a similar manner of opening and closing the dark slide in the disc camera, and the processing solution can be directly supplied to the emulsion side of the disc film by using this mechanism. The method of pouring, coating or spraying the solution can be freely selected as the method of feeding the processing solution and it is possible to combine this example with the example of apparatus 3 wherein a concave section for collecting the solution provided.

APPARATUS EXAMPLE 5

Figure 7:
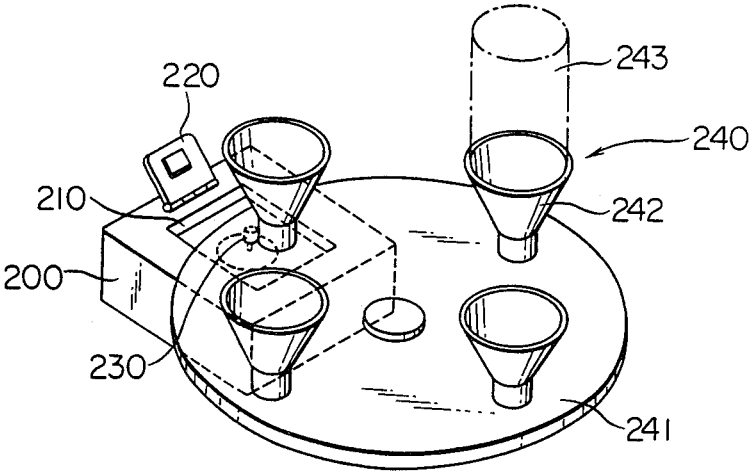
FIG. 7, FIG. 13, and FIG. 23 are perspective views of the same.

FIG. 7 illustrates other example of the disc film developing device according to the present invention.

In the diagram, 200 is a rest on which a concave 210 section is formed to receive the cartridge 10 of the disc film. A flat portion of this concave 210 is basically preferably to take a form of a square and more preferably to correspond with the external shape of the cartridge 10. The allowable depth concave 210 may be of being deep enough to hold the cartridge 10 properly while the disc film being rotated as described later. Also, this example also includes a rest 200 whose top surface is made smooth and flat, replacing the concave 210, and has a means of continuous or discontinuous convex strations which correspond with the external shape of the cartridge 10 so that the cartridge 10 is held on the rest 200.

220 is a member to control the movement of the cartridge 10, and the member 220 illustrated is biased to clockwise by a spring to press downward the top end of the cartridge 10 placed in the concave 210. The shape and quantity of the holding member 220 are not limited, but may be so designed, for example, as to be a member having an aperture slightly smaller than the external shape of the cartridge 10 and almost covering the top of the rest 200 or a member like a covering plate having an opening in the part that correspond with the whole or a part of the exposure aperture 12, curved slot 14 and the center aperture 13, or a member including various other designs.

230 is a rotating mechanism of the disc film and the rotating mechanism shown is rotated (including reverse rotation) by means such as a motor, by engaging an engaging means which is caused to protrude above the top of the concave 210 of the rest 200 with the hub 21 of the disc film 20 which is exposed in the center aperture 13 of the cartridge 10.

The rotating means 230 of the disc film includes those operated manually, for example, by the rotation of a lever or a knob instead of a motor.

240 is a supply means of the developing solution, and the means shown has a turn table 241, on which a plurality of adaptors 242, 242 for supplying the developing solution are provided, and each adaptor has the cassette 243 which contains developing solution such as color developing solution, bleaching and fixing solution, and stabilizing solution as substitution for washing. Though chemical compositions, concentration, temperature and other factors of the developing fluid prepared in each cassette 243 are important factors for the developing processes, these factors are not limiting the present invention but can be prepared in various ways, and therefore, the description thereof is omitted. Referring to the temperature control, it is preferred that a heating means is provided on the side of the rest 200 to heat the whole of the cartridge 10 or in addition to or in place of such heating means, a heating means is provided for the adaptor 242 etc. to supply the developing fluid whose temperature is controlled to a specified level. In this case, it is more preferable to have the whole cassette 243 preheated before setting the cassette 243 into the adaptor 242.

It is preferred that the developing solution supply means 240 is provided with a cleaning means by using one adaptor 242 or by providing an independent supply opening.

In the example shown, the developing fluid (cassette) is caused to be guided to the specified position on the rest 200 through the rotation of the turn table 241.

The example according to the present invention will also include various methods, such as fixing an adaptor 242 at the specified position above the concave 11 of the rest 200 without using the turn table 241, using a means which rotates round the rest 200, or using a holding means of the adaptor 242 (cassette 243) having the same function as the turn table 241.

For supplying the developing solution, by means of the adaptor 242, over the emulsion side of the disc film 20, various methods such as coating, dripping and spraying which are to be explained in later examples, can be applied.

A developing method will be described, where the developing device shown in the diagram is employed with the disc film being contained in the cartridge.

The cartridge 10 containing the exposed disc film is placed on the concave of the rest 200 with the exposure aperture 12 facing upward in FIG. 7, and the cartridge is restricted by the holding member 220 from flying off upward from the rest. Upon setting the cartridge 10, the engaging member of the rotating means 230 is engaged with the aperture of the hub 21 of the disc film 20.

Then, the heating means provided on the side of the adaptor 242 is turned on to heat the processing solution in the cassette 243 being installed on the adaptor 242, after the predetermined temperature is achieved, the developing solution is supplied to the emulsion side of the disc film 20 in the cartridge 10 through the exposure aperture 12 (and/or the aperture 16, the center aperture 13).

If the temperature drop of the developing solution is excessive after the solution is supplied into the cartridge 10, it is preferable that the heating temperature is set to slightly higher level or a heating means is provided on the side of the rest 200. During the color developing process, the disc film 20 is rotated by the rotating means 230. As the disc film 20 is rotated in the cartridge 10, the color developing solution over the emulsion side is sheared by the attached member in the cartridge 10 over the emulsion side of the disc film or by the frictive contact with the sponge etc. provided at the lower end of the adaptor 242.

When the predetermined time period for the color developing process has been elapsed, the movement of the rotating means 230 is stopped, the turn table 241 is rotated, the color developing solution remaining in the cartridge 10 is discharged, the cartridge 10 is cleaned, bleaching solution or bleaching and fixing solution is supplied, and the rotating means 230 is started.

Developing processes will be carried in like manner, the cartridge 10 is removed from the rest 200 upon completion of processes, the cartridge 10 is broken by the cartridge opener or by hand, and the disc film 20 is taken out to be dried.

In case the stabilizing process which substitutes for the washing with water is not used but the conventional washing with water is employed, the cartridge 10 may be broken and the disc film 20 taken out before washing and then washing drying operations are carried out. All of the above processes or a part thereof can be automated or the whole processes can be handled manually. For automating the processes, automatic controls will be carried out in connection with the rotation and position controls of the turn table 241, temperature control of the solution, control of supply and discharge of the solution, control of the disc film rotating means and control time.

APPARATUS EXAMPLE 6

Figure 8:
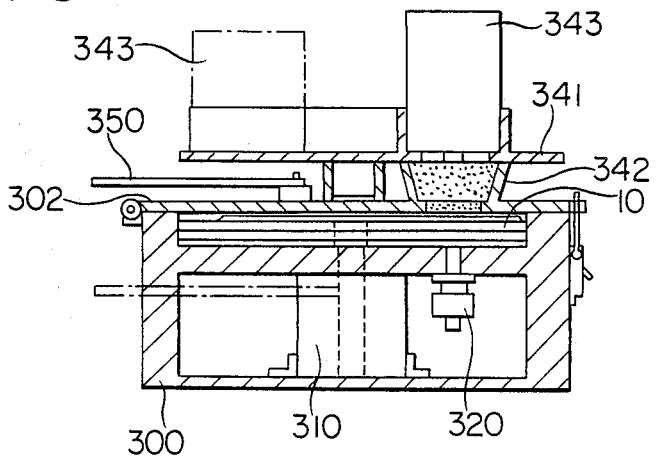

Referring to FIG. 8, other examples will be described regarding a developing device to which the developing method of the disc film according to the present invention is applied.

In the diagram, 300 is a rest on which a concave is formed to receive the cartridge 10 and under said rest are provided the motor of the rotating means 310 for the disc film and the solution discharging means 320.

This example also includes a means which rotates the disc film by manual operation by means of the lever operation or gears or pulleys, replacing the motor.

302 is a holding member, and one end of the means shown is fixed to the end of the rest 300 by means of a hinge mechanism, and the other end is secured to the rest 300 by means of a clamp. It is preferable to constitute the holding member 307 as being a light shielding and water-proof construction around the top periphery of the rest 300 using sealing materials such as packings.

The holding means 302 is provided with sponges having functions to shut off light and to allow the solution flow therethrough, and a means 350 for opening and closing the dark slide of the exposure aperture 12 of the cartridge 10. This dark slide operation means 350 which may be actuated by a lever serves to open and close the dark slide which shut off the light and is provided at the exposure aperture 12 of the cartridge 10, the same mechanism as a dark slide operating mechanism of the disc camera can be applied to this dark slide operation means 350.

341 is a turn table installed through a bearing member provided at the center of the holding member 302, and the cassettes 343 for developing solution are radially provided on this turn table. The turn table 341 rotates on the center of the bearing member and the cassette 343 are guided in sequence onto the adaptor 342.

The sponges in the adaptor 342 are prepared for two purposes; one is to prevent the disc film 20 from being exposed to light even when opening the dark slide of the exposure aperture 12 of the cartridge 10 and the other is to provide friction contact with the emulsion side, while a bundled materials such as fibers or cotton can be used instead of the sponge.

The adaptor 342 may be formed in labyrinthic structure to shut off the light, allowing only the processing solution to pass and further, it is preferable to provide a safety mechanism to make it impossible to remove the cassette 342 when the dark slide is opened.

It is the same as the case of the example shown in FIG. 7 wherein a heating means is provided on the turn table 341 and/or on the side of the rest 300.

The developing processes of the disc film by the device illustrated in FIG. 8 is almost the same as that shown in FIG. 7.

APPARATUS EXAMPLE 7

Figure 9:
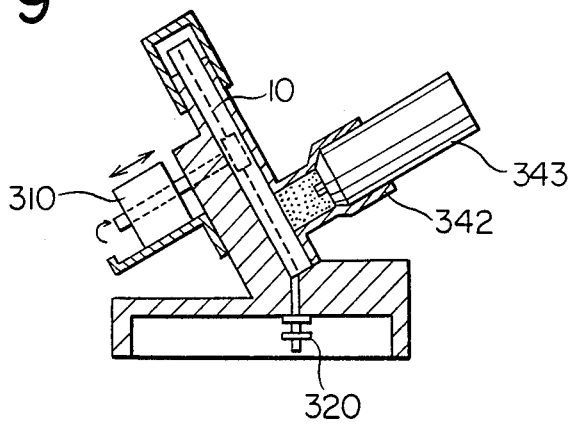

Operation is carried out by the device illustrated in FIG. 9, wherein the cartridge 10 of the disc film is inserted into the pocket which may be covered and fixed as required.

In the same manner as the preceding example, a rotating means 310 for the disc film by a motor or hand, a processing solution-supply means having an adaptor 342 and a cassette, and a solution discharging means 320 using an electrically operated valve or manual cock or a plug are arranged.

APPARATUS EXAMPLE 8

In the descriptions of examples illustrated in FIG. 7 and FIG. 8 of above, two methods of supplying the photographic processing solution are available; one is a system wherein the dark slide of the cartridge 10 is opened, so that the solution is directly applied to or dripped on the emulsion side of the disc film 20 by means of a cassette through sponges, and the other is a system wherein the solution is poured into the cartridge from the aperture thereof with the dark slide being closed.

Figure 10:
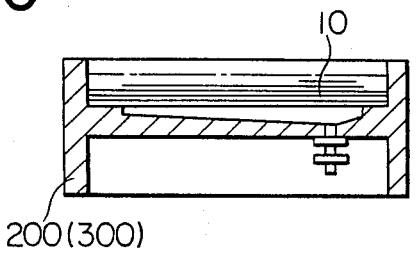

In the former system, spraying may also be employed in addition to coating or applying and dripping of the solution, and for example, a means such as air pump may be prepared in addition to the device shown in the diagrams so as to cause the solution in the cassette to spray from the nozzle of spraying means. In the latter system, as shown in FIG. 10 for example, it also includes an embodiment wherein the concave of the rest 200 (300) is formed slightly deeper that the of the cartridge 10 to cause the overflowing solution from the cartridge 10 to be collected in the concave. In the case of such embodiment, it is also permitted that the cartridge 10 is arranged to have the exposure aperture 12 faced to downward and the emulsion side of the disc film is caused to face downward.

APPARATUS EXAMPLE 9

In this example, the disc film, as it is contained in the cartridge, is processed at least up to the bleaching or the bleaching and fixing process by means of immersion process. In other words, the cartridge is utilized as a light shut-off structure (container) during the photographic processing process which is carried out by allowing the processing solution to permeate into the cartridge through the clearance thereof.

Figure 11:
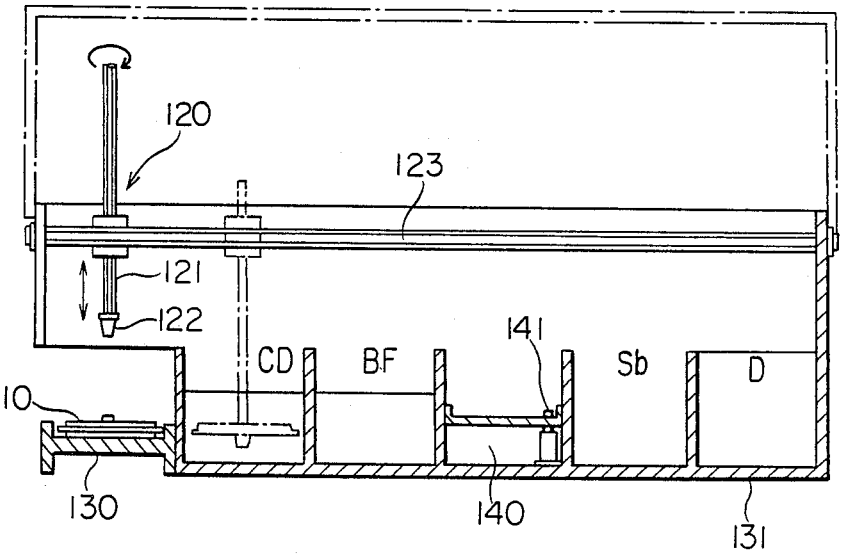

In FIG. 11, number 10 is the cartridge of the film unit in which the exposed disc film is contained and the cartridge 10 of the disc film 20 to be developed is first prepared by being placed on the starting rest 130.

Turning on the start switch lowers the rod 121 for moving up and down in the transfer system, and the chuck 122 provided on its tip grips the cartridge 10 by use of the center aperture of the cartridge, and the rod 121 goes up. Then, the rod 121 moves along the guide rail 123 toward right direction in the diagram and stop at the position of the color-forming developing tank CD, and the tod 121 lowers to immerse the cartridge 10 into the color-forming developing solution. The developing solution enters into the cartridge 10 through, for example, the exposure aperture and center aperture and, contact with the emulsion surface of the disc film to effect color-forming developing process. After a certain time has elapsed, the rod 121 again rises as holding the cartridge 10, proceeds to the bleach fixing tank BF, and then to cutting section 140. In the cutting section, the periphery of the cartridge 10 is cut by the cutting blade 141, and the disc film is released from the cartridge 10. Then, the film is sent to the washing substituent stabilizing tank Sb.

In the embodiment shown, the cartridge is broken in the cutting section 140, but the cutting device may be arranged in or above the bleach fixing tank BF, or in or above the washing substituent stabilizing tank Sb. When provided in the tank, it may be favorable not only for preventing the corrosion of the cutting device but also for reducing the size of the whole apparatus smaller, if the process is operated in following order as cutting→injecting the stabilizing solution for the substitution of water washing→washing completion→discharging the stabilizing solution→transfer of cartridge 10, without setting the cutting device in the tank being kept on the filled up condition with the stabilizing solution.

In the embodiment as shown, the disc film still remain being engaged with the chuck 122, after the cartridge has been cut.

In addition to cutting the whole periphery of the cartridge 10 by a cutting blade, various designs of breaking means of the cartridge 10 are available, such as, the base part of the exposure aperture 12 side of cartridge 10 is cut and then the label side 18 is peeled off the aperture side 11, a claw is inserted into the joint face between the label side 18 and the aperture side 11 from the end portion opposite to the exposure aperture 12 and then both the sides are pulled opposite to each other for separation, and that using a rotary blade instead of the claw. It is also possible to break the cartridge by hand, by using such means as described in other embodiments, or by using a cartridge opener such as the opener model H made by Kodak Co., as required.

After these processings have been completed, the cartridge 10 being reached at the finishing rest 131 is released from the chuck 122 of the rod 121 and dried for a predetermined time.

The composition of the photograph processing tanks shown is a typical embodiment, and is not to limit the present invention. Other embodiments, for example, those having a color-forming developing tank CD, bleaching tank BL, stabilizing tank FIX, washing substituent stabilizing tank Sb, and the second stabilizing tank should be included. In this embodiment, the disc film is released from the cartridge 10 after receiving bleaching treatment in the bleaching tank BL.

In the embodiment shown in FIG. 11, for example, the drying section D is not necessarily provided, but the disc film 20 which has been washed may be directly taken out from the finishing stand 131 and dried by a drying means provided separately.

As the chuck mechanism of the carrying system 120 comprising a chuck 122 which carries the cartridge 10 fixed to the tip of rod 121, a starting rest 130, and a finish rest 131, available are that of the disk film supply system described in Japanese Utility Model Registration O.P.I. Publication No. 170,845/1984.

Instead of the chuck mechanism, various designs are possible such as carrying a cartridge put on a dish, net, etc., or that carrying a cartridge gripped partially.

The whole transfer system 120 is also not limited to the composition shown in FIG. 11, but various designs are possible. Also, in a system which each processing tank can be arranged radially, and the rod 121 is moved in circumferential direction to guide the cartridge 10 to each photographic processing tank, and conversely, in a system which arranges each photograph processing tanks radially on a turntable, to move them to the rod 121 fixed to a position may be possible.

The transfer system 120 shown in FIG. 11, also includes those, for example, which has a mechanism to rotate the disk film 20 in the cartridge by the rod 121 itself or by a rotating rod incorporated in the rod 121 to stabilize the photographic processing and to improve the sharpness utilizing the stable shearing force and the contact effect of the processing solution on the emulsion face of the disk film.

In the case of such embodiment, the cartridge 10 may be rotated while fixing the disk film 20, or both may be rotated in reverse direction with each other. It is also preferable to make the center of rotation eccentric.

No high-speed rotation is necessary, because too fast rotation speed may injure the emulsion surface.

APPARATUS EXAMPLE 10

Figure 12:
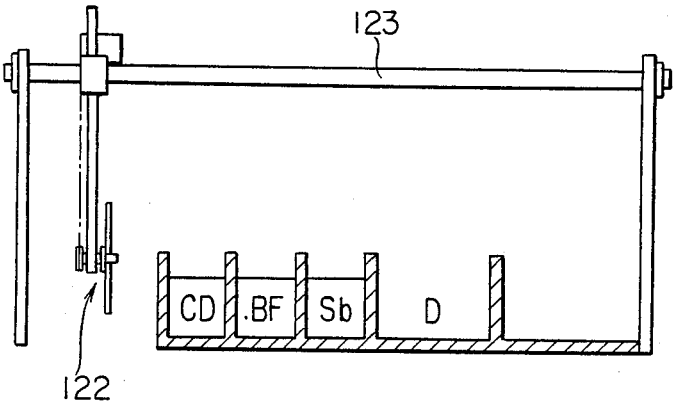

As shown in FIG. 12, this Example processes the photograph by immersion method with the cartridge held vertical. The cartridge 10 is attached to a chuck mechanism 122 held by a guide 123 and supplied to each photographic processing tank along the guide rail 123. To move the cartridge to the processing tank of the next process, any system that moves the guide rail 123 up and down, that moves holding member up and down while fixing the guide rail 123, that moves the processing tank up and down and in horizontal direction, or a combination of these is available.

The cartridge 10 is held with the exposure aperture thereof facing downward and immersed in the processing solution in the processing tank to a part thereof being a little higher than the exposure aperture 12 in depth.

APPARATUS EXAMPLE 11

Figure 13:
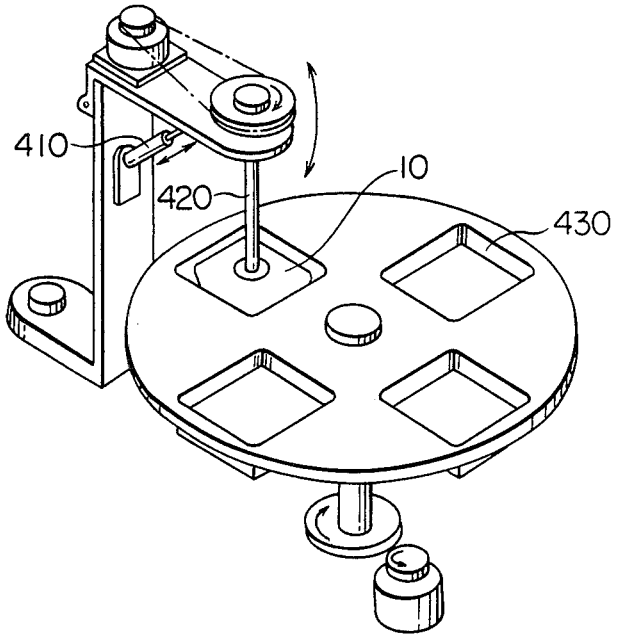

As shown in FIG. 13, the cartridge 10 is held by a chuck mechanism provided on the bottom end of the shaft 420 which is moved up and down by actuation of solenoid 410. A turntable (or arms may be applicable which is provided radially with a processing tank on each tip, not a turntable) arranged with processing tanks 430 having heating means and accommodating a processing solution may be intermittently rotated by a motor to guide each processing tank to the position of the cartridge 10.

Instead of the up-and-down mechanism of cartridge 10 by solenoid 410, a lifting device may be provided in the turntable side.

In this embodiment also, the disk film 20 is rotated like in other embodiments.

APPARATUS EXAMPLE 12

Figure 14:
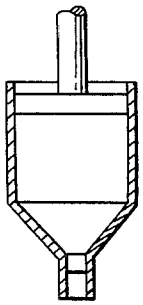
FIGS. 14 and 15 are sectional views showing a supply mechanism of the processing solution.
Figure 15:
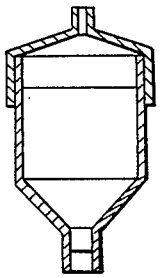
Figure 16:
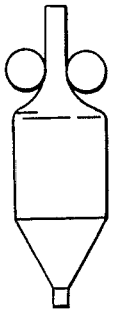
FIGS. 16 and 17 are front views showing the same.
Figure 17:
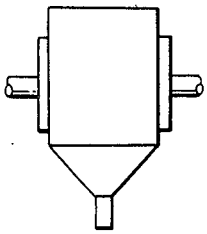

This Example shows an embodiment of supply mechanism which supplies at least a dose of processing solution by use of a cassette. FIG. 14 shows a device which push out a dose of processing solution in a cassette accommodated in a holder by pressing from the rear end by a pressing mechanism such as solenoid. FIG. 15 shows an example of pushing out by air pressure. FIGS. 16 and 17 show mechanisms which squeeze out the processing solution by roll or press plate.

APPARATUS EXAMPLE 13

Figure 18:
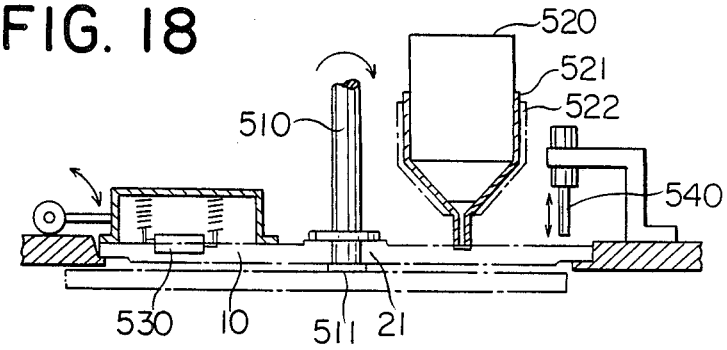

As shown in FIG. 18, this apparatus engages the chuck attached to the tip of the rotary shaft 510 with the hub 21 of the exposed disk film accommodated in a cartridge 10 placed in the concave of the rest, and performs photogrpahic processing while rotating the disk film 10.

Each photographic processing solution is preferably prepared in the form of being accommodated in a cassette 520 and then mounted with the cassette 520 in the holder 521. The holder 521 is incorporated with a heater 522, and temperature-adjusted processing solution is supplied through, for example, a curved aperture 14 for opening and closing the dark slide into the cartridge. The processing solution supplying section of the holder 521 may serve also as an opening and closing mechanism of the dark slide.

On the other hand, the exposure aperture 12 of a cartridge 10 is provided with a roller 530 being biased downward with a spring or the like, and shielded from light with a shielding member, thereby the roller may press the emulsion surface of the disc film 20 being rotated by the rotating shaft 510.

A knockout pin 540, capable of being moved to up and down by solenoid, pushes out the label side 18 through the apertures 16 of a cartridge 10 in FIG. 1 and breaks the cartridge 10.

In this embodiment, a heater is preferably provided also in the rest side.

APPARATUS EXAMPLE 14

Figure 19:
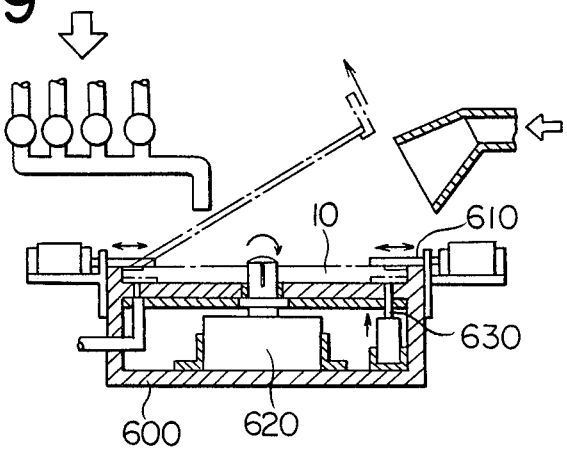
Figure 20:
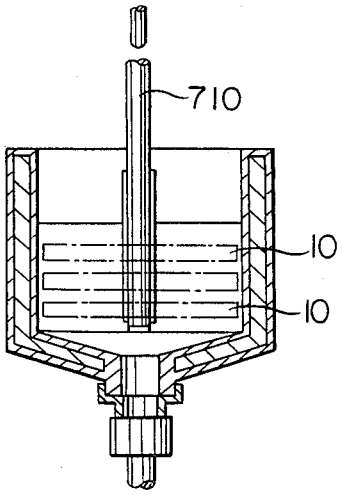

As shown in FIG. 19, a cartridge 10 accommodating an exposed disc film is placed in the concave on top of the rest 600 with the label side 18 thereof directing upward, and fixed the top face thereof by a press member 610 actuated, for example, by a solenoid. The hub 21 of the disk film 20 is engaged with the chuck mechanism provided on the end of the rotary shaft rotated by a motor 60. Preferably using a cassette containing a quantity sufficient to process one sheet of disc film or using a control means such as a solenoid valve, the processing solution is supplied to the concave of the rest 600. The apparatus of this example performs photograph treatment in the condition that the whole cartridge is immersed in the processing solution while rotating the disc film 20.

It is preferable that the processing solution is adjusted in temperature as being accommodated in the cassette or after released from the cassette, the solution is adjusted it's temperature and then supplied to the concave of the rest 600. It is more preferable that the temperature of the processing solution during processing is controlled by the heater provided in the rest 600 side.

The knockout pin 630 is moved in up and down direction, for example, by a solenoid and inserted into aperture 16 to peel off the label side 18 from the exposure aperture side 11. The peeling may be carried out any time after the fixing has been completed.

APPARATUS EXAMPLE 15

Figure 21:
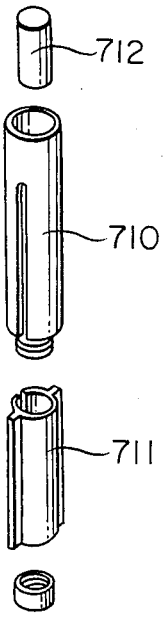
FIG. 21 is an exploded perspective view of a rotary shaft.

As shown in FIGS. 20 to 23, the apparatus of this Example processes simultaneously a plurality of cartridges 10 each of which accommodates a exposed disc film 20. To fix a cartridge 10 to the rotary shaft 710 driven by a motor, as shown in FIG. 21, for example, engaging members 711 are arranged to one or more slits provided on the rotary shaft 710, and they are expanded in width direction by the insertion or screw-in of the rods 712 to engage with the center aperture of the disc film. To release the engagement, rods are pulled out to free the engaging members 711.

Figure 22:
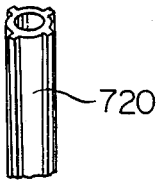
FIG. 22 is a perspective view of an adaptor.

Simple method is that, as shown in FIG. 22, an attachment 720 is formed by using soft material such as rubber, and the attachment being attached to the lower end of the rotary shaft 710 is inserted into the hub 21 of the disc film 10.

Also, it is applicable that at least the lower portion of the rotary shaft 710 may be formed by using soft material.

Figure 23:
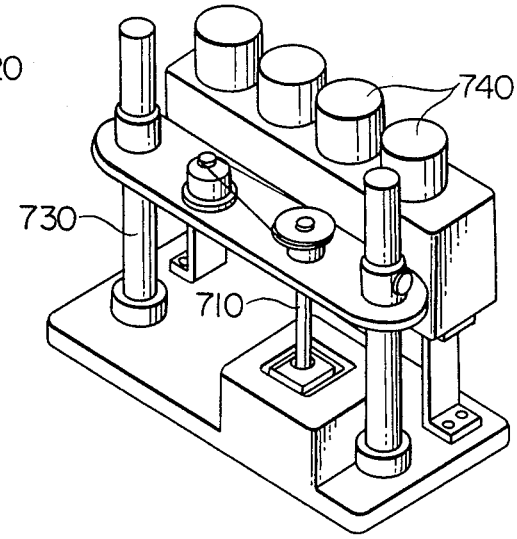

As shown in FIG. 23, the rotary shaft 710 is installed through a support member movably in up and down direction, and the rotation of the motor is transmitted to the shaft 710 through a pulley, gear, etc.

The processing solutions are prepared preferably into processing solution supply means capable of temperature control in cassette 740 or in a tank without any cassette. By the control by a solenoid valve, etc., for example, the processing solution is supplied in quantities corresponding to the number of disk films successively according to the specified photographic processing process.

The advantage of this Example is that the cartridge can be processed singly or two or more simultaneously. For example, the processing solution may be supplied in a quantity corresponding to the number of cartridges up to the top position of them. This is advantageous for processing with minimized the quantity of processing solution.

APPARATUS EXAMPLE 16

Figure 24:
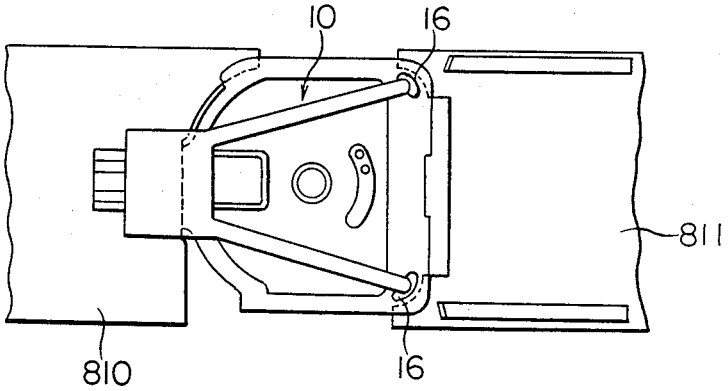
FIG. 24 is a plan view showing an embodiment having a breaking mechanism of the cartridge.
Figure 25:
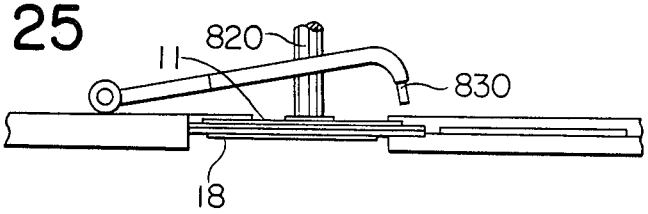
FIG. 25 is a front view of the same.
Figure 26:
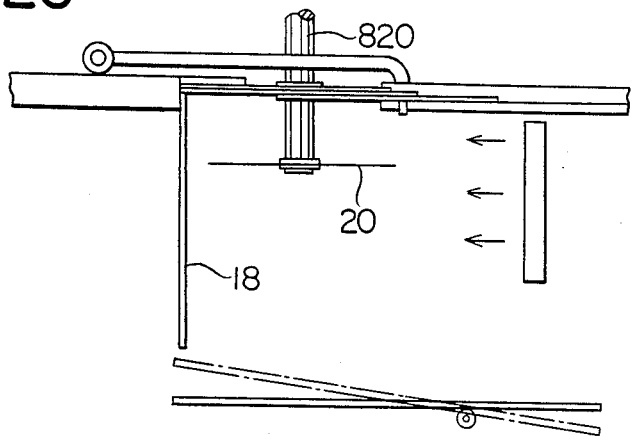
FIG. 26 is a front view showing the broken condition of the cartridge, FIGS. 27-*a*, 27-*b* and 27-*c* are schematic sectional views showing arrangements between disk film and resistive member.

With reference to FIGS. 24 to 26, an embodiment incorporated with a cartridge breaking mechanism is described. With respect of photographic processing solution supply mechanism, and cartridge holding and rotating mechanism, those indicated in aforementioned Examples can be selected as required and applied to this Example.

As shown in FIG. 24, cartridge 10 accommodating exposed disk films is held horizontally by bases 810 and 811 on the exposure window side plate directing upward, and in the same manner as in aforementioned Examples, hub 21 of disc film 20 is engaged with the chuck mechanism of rotary shaft 820 capable of being rotated by a driving means such as motor to rotate the disc film.

Bases 810 and 811 holds cartridge 10 by pushing it in horizontal direction and by supporting the lower edge of exposure window side plate 11, with touching the label side plate 18. Numeral 830 denotes knockout pins formed on the ends of the arms and capable of being driven by the arm driving mechanism (not shown). These pins 830 are inserted into thorugh holes 16, 16 formed in the exposure window side plate 11 and presses down the label side plate 18 breaking the junction in between the exposure window side plate 11. The pins 830 may be moved in linear reciprocating motion in up-and-down direction by use of, for example, solenoids instead of the arm mechanisms.

It is also allowable as an example that the arms shown in the drawings may be attached to the base 810 and there may be further provided a peeling means capable of engaging with the tip end of the label side palte 18 being pushed out by the pin 820 and peeling it and a cutting means for cutting an edge part of the cartridge 10 or a junction inbetween the exposure window side plate 11 and the label side plate 18 by using a cutter.

Upon completing the washing process, the above cartridge breaking mechanism is actuated, and as shown in FIG. 26, peels off label side plate and then drying by the heater is performed while rotating disk film 20. Upon completing the drying, the chuck mechanism formed on the end of rotary shaft 820 is actuated to release the engagement with disc film 20. The disc film is dropped naturally and discharged through the guideway to the outside.

PHOTO PROCESSING SOLUTION

Then, typical example of processing solution for color photograph which can develop the disc film according to the invention will be detailed.

In the invention, each processing solution is preferably supplied in necessary quantity for treating one disc film sealed in cassette. However, they may be supplied in a quantity for treating a plurality of disc films.

Though it is preferable that the processing solution is set to the processing equipment as accommodated in cassettes, but the invention is not limited by this, or the specific constitution is not a limiting requisite.

Color-forming developing solution is a processing solution used in the color forming developing process (process for forming color images, specifically a color image is formed by the coupling of a color-forming developing agent and a color coupler). Therefore, it is usually necessary in a color-forming developing process that the color-forming developing solution contains color-forming developing agent. It is included that color-forming developing agent is built in the color photomaterial, and treated with a color-forming developing solution containing a color-forming developing agent, or alkali solution (activator solution). The color-forming developing agent contained in the color-forming developing agent is a primary aromatic amine including aminophenol and p-phenylenediamine derivatives. These color-forming developing agents can be used in the form of salts of organic acid and inorganic acid such as chloride, sulfate, p-toluensulfonate, sulfite, oxalate, and benzenedisulfonate. These compounds are generally used in a concentration of about 1–15 g per 1 l developer, preferably about 1–15 g per l developer.

The above aminophenol series developer includes o-aminophenol, p-aminophenol, 5-amino-2oxy-toluene, 2-amino-3-oxytoluene, 3-oxy-3amino-1, 4-dimethylbenzene.

The color-forming developing solution can contain those usually used in a developer, an alkaline agent such as sodium hydroxide, potassium hydroxide, ammonium hydroxide, sodium carbonate, potassium carbonate, sodium sulfate, and sodium metaborate or borax. Further it can contain various additives such as benzyl alcohol, halogenated alkalimetal such as potassium bromide, and potassium chloride, or a development adjuster such as citrazinic acid, preservatives such as hydroxylamine and sulfite. Further, various anti-foaming agent or surfactant, or organic solvents such as methanol, dimethylformamide, and dimethylsulfoxide may be contained. The pH value of the color developing developer is usually 7 or more, preferably about 9–13.

The color-forming developing solution can contains as required an antioxidant such as diethylhydroxyamine, tetronic acid, tetronimide, 2-anilinoethanol, dihydroxyacetone, aromatic secondary alcohol, hydroxamic acid, pentose or hexose, and pyrogallol-1, 3-dimethy ether. Further, in the color developing developer, various kchelete may be used as a sequenstering agent. As the chelete agent, aminepolycarbonic acid such as ethylenediamine tetraacetic acid chelete and diethylenetriamino pentaacetic acid chelete, organic sulfonic acid such as 1-hydroxyethylidene-1, 1-disulfonic acid, aminopolyphosphonic acid such as aminotri (methylenephosphonic acid) or ethylenediaminetetralinic acid, oxycarbonic acid such as citric acid and gluconic acid, phosphonocarbonic acid such as 2-phosphonobutane-1,2,4-tricarbonic acid, polyphosphoric acid chelete such as tripolyphosphoric acid and hexamthaphosphoric acid, and polyhydroxy compounds are mentioned.

Bleach fixing solution is used in bleach fixing process (metal silver produced by development is oxidized into silver halide, then a water soluble complex is formed and makes color undeveloped portion develop color) and the bleaching agent used in the bleaching fixing solution may be any type. Metal complex of an organic acid is, for example, an organic acid such as aminopolycarbonic acid, boric acid, and citric acid coordinated by a metal ion such as iron, cobalt, and copper. Organic acids used for forming such metal complex of organic acid are polycarbonic acids and aminopolycarbonic acids. These polycarbonic acids or aminopolycarbonic acids may be alkalimetal salts, ammonium salts, or water soluble amine salts. Specific examples are ethylenediaminetetraacetic acid, diethylenetriaminepentaacetic acid, ethylendiamine-N-(β-oxyethyl)-N,N,N-triacetic acid, propylenediaminetetraacetic acid, nitotriacetic acid, cyclohexanediaminetetraacetic acid, iminodiacetic acid, dihydroxyethylglycinecytric acid (or tartaric acid), ethyletherdiaminetetraacetic acid, glycolether diaminetetraacetic acid, ethylenediaminetetratetrapropyonic acid, phenylenediaminetetraacetic acid, disodium ethylendiamine tetra acetate, ethylenediaminetetraacetic acid tetra (trimethylammonium) salt, tetrasodium ethylenediamine tetraacetate, pentasodium diethylenetriaminepentaacetate, sodium ethylenediamine-N-(β-oxyethyl)-N,N,N-triacetate, sodium propylenediaminetetraacetate, sodium munitryloacetate, and sodium cyclohexanediaminetetraacetate. These bleaching agents are used in a quantity of 5–450 g/l, more preferably 20–250 g/l. The bleaching fixing solution can contain, in addition to the above beaching agent, silver halide as a fixer and, as required, a sulfite as a preservative. Sometimes a special bleaching fixing solution may be used such as: having a composition comprising (ethylenediaminetetraacetato)-iron (III) complex and a small quantity of halide such as ammonium bromide other than the above silver halide fixing agent, or a composition having, conversely, a large quantity of halide such as ammonium bromide, or a composition comprising combination of (ethylendiaminetetraaceto) iron (III) complex bleaching agent with a large quantity of halide such as ammonium bromide. In addition to ammonium bromide, hydrochloric acid, hydrobrobromic acid, lithium bromide, sodium bromide, potassium bromide, sodium iodide, potassium iodide, and ammonium iodide are also available as the above mentioned halide.

The silver halide fixing agent contained in the above bleaching fixing solution is a compound which forms a water soluble silver salt by reacting with a silver halide commonly used in ordinary fixing is, for example, a thiosulfate such as potassium thiosulfate, sodium thosulfate, and ammonium thiosulfate, a thiocyanate such as potassium thiocyanate, sodium thiocyanate, and ammonium thiocyanate, thiourea, and thioether. These fixing agents are used in a quantity of 5 g/l or more or in the soluble range. It is generally used in a range of 70–250 g/l.

The bleaching fixing solution may contain various pH buffers such as boric acid, borax, sodium hydroxide, potassium hydroxide, sodium carbonate, potassium carbonate, sodium bicarbonate, potassium bicarbonate, acetic acid, sodium acetate, and ammonium hydroxide singly or in combination of two or more. Further, it may contain various fluorescent brightening agent, antifoaming agent, or surfactants. Also it may contain preservative such as hydroxylamine, hydrazine, and bisulfite addition compounds of aldehyde, organic chelating agent such as aminopolycarbonic acid, stabilizer such as nitro alcohols and nitrates, and organic solvents such as methanol, dimethylformamide, and dimethylsulfoxide. Further, the bleaching fixing solution may have added various bleaching accelerator described in Japanese Patent O.P.I. Publication No. 280/1971, Japanese Patent Examined Publication No. 8506/1970, Japanese Patent Examined Publication No. 556/1971, Belgian Pat. No. 770,910, Japanese Patent Examined Publication No. 8836/1970, Japanese Patent Examined Publication No. 9854/1978, Japanese Patent Examined Publication No. 71634/1979, and Japanese Patent Examined Publication No. 42349/1975.

The pH value of the bleaching fixing solution is 4.0 or more. It is generally used in a range from 5.0 to 9.5; preferably, 6.0 to 8.5; and most preferably, in a range of 6.5 to 8.5.

The bleaching fixing treatment may be separately carried out separately in bleaching treatment by bleaching solution comprising mainly bleaching agent and fixing treatment by fixing solution comprising mainly fixing agent.

The washing-substituent stabilizing solution is not an ordinary stabilizing treatment but a washing-substituent stabilizing treatment, and denotes picture stabilizing treatment as described in Japanese Patent O.P.I. Publication No. 134,636/1983 and Japanese Patent O.P.I. Publication No. 2709/1983, for substantially removing the washing operation. Therefore, the name of the processing bath is not necessarily stabilized treatment.

The stabilizing solution includes function for stabilizing picture and a dewatering function for preventing washing unevenness. Color development control solution and antistatic solution containing an antistatic agent are also included in the stabilizing solution. The stabilizing bath is provided with a means for neutralizing, desalting, and inactivating any bleaching or fixing component brought in from the preceding bath, to prevent deterioration of the coloring matter.

Such components contained in the stabilizing solution are, for example, chelating agents of chelete stability constant 6 or more (preferably 8 or more). Such chelating agents include organic carbonic acid chelating agent, organic phosphoric acid chelating agent, polyhydroxy compounds, and inorganic phosphoric acid chelating agent, among which preferable are ethylenediaminediorthohydroxyphenylacetic acid, nitrilotriacetic acid, hydroxyethylenediaminetriacetic acid, diethylenetriaminepentaacetic acid, hydroxyethyliminediacetic acid, diaminopropanoltetraacetic acid, ethylenediaminetetrakismethylenephosphonic acid, nitrilotrimethylenephosphonic acid, 1-dihydrodiethylidene-1, 1-disulfonic acid, 1, 1-diphosphonoethane-2-carbonic acid, 2-phophonobutane-1,2,4-tricarbonic acid, 1-hydroxy-1-phosphonopropane-1, 2,3-tricarbonic acid, catechol-3, 5-disulfonic acid, sodium pyrophosphate, sodium tetrapoyphosphate, and sodium hexamethaphosphoric acid. The most preferable for the effect of this invention are diethylenetriaminepentaacetic acid, 1-hydroxyethylidene-1, 1-diphosphonic acid and salts thereof. These compounds are used in a concentration of about 0.1–10 g/l; preferably about 0.5–5 g/l based on the stabilizing solution.

The compounds to be added to the stabilizing solution contians ammonium compounds. These are supplied in the form of ammonium salts of various inorganic compounds. Specifically, they are, for example, ammonium hydroxide, ammonium bromide ammonium carbonate, ammonium chloride, ammonium hypophosphite, ammonium phosphate, ammonium phosphite, ammonium fluoride, acid ammonium fluoride, ammonium fluoroborate, ammonium arsenate, ammonium hydrogen carbonate, ammonium hydrogenfluorate, ammonium hydrogen sulfate, ammonium iodide, ammonium nitrate, ammonium pentaborate, ammonium acetate, ammonium adipate, ammonium aulinetricarbonate, ammonium benzoate, ammonium carbamate, ammonium citrate, ammonium dithiocarbamate, ammonium oxalate, ammonium hydrogenmalate, ammonium hydrogen oxalate, ammonium hydrogenphthalate, ammonium hydrogen tartalate, ammonium lactate, ammonium malate, ammonium malate, ammonium oxalate, ammonium phthalate, ammonium picrate, ammonium pyrrolidinedithiocarbamate, ammonium salicylate, ammonium succinate, ammonium sulfanilate, ammonium tartarate, ammonium thioglycolate, and 2,4,6-trinitrophenol ammonium.

The quantity of these ammonium compounds to be added to the stabilizing solution is in a range of 0.05–100 g/l, preferably, 0.1–20 g/l.

The compounds to be added to the stabilizing solution are, for example, a pH adjuster such as acetic acid, sulfuric acid, hydrochloric acid, nitric acid, sulfanilic acid, potassium hydroxide, sodium hydroxide, and ammonium hydroxide, an antifungal agent such as sodium benzoate, butylhydroxybenzoate, antibiotics, tetrahydroacetic acid, potassium solbate, thiapentazol, and ortho-phenylphenol, a preservative such as 5-chloro-2-methyl-4-isothiazoline-3-on, 2-octyl-4-isothiazoline-3-on, and water soluble metal salts, dispersant such as ethylene glycol, polyethylene glycol, and polyvinyl pyrrolidone, (PVP K-15, Rubiscol K-17, etc.), film hardening agent such as formalin, and fluorescent brightening agent. Among these additives, the ammonium compounds described in Japanese Patent Application No. 58,692/1983 Specification works in the picture coat to adjust the pH value to weak acidic best suited to pH preservation. The compounds used together with the ammonium compounds are an acid such as sulfuric acid and hydrochloric acid.

The pH value of the stabilizing solution is adjusted in a range of 0.1–10, preferably in a range of 2–9, more preferably 4–8.5. The stabilization process is carried out in multistage tank system. The replenishing solution is supplied from the final-stage tank and overflowed successively toward earlier stage. This favorably decreases the quantity of replenished solution. After stabilizing treatment, no rinsing treatment is required. However, a minimum duration of rinsing with minimum amount of water, or surface rinsing or the like may be practiced if so required.

If stabilizing treatment is carried out immediately after the bleach-fixing treatment, without substantially involving rinsing treatment, a short duration of silver recovery, rinsing in standing water or the like may be provided between the bleach-fixing treatment and the stabilizing treatment. After the stabilizing treatment, dewatering bath containing surface active agent and other bathes may be provided. However, the silver recovery bath, rinsing bath, dewatering bath and the like should not preferably be provided. During such additional treatments, spraying or coating process may be incorporated.

Additionally, conditioning tank may be provided after the above-mentioned color developing treatment. The conditioning tank is used to stop development and to accelerate bleaching reaction, and is advantageous in preventing developer from contaminating bleach-fixer so as to minimize the adverse effect of the developer. The conditioning tank contains, for instance, bleach-accelerator and buffer agent. As the bleach-accelerator, organosulfur compounds, such as mercapto compounds and thione compounds are principally used. Further, acids such as acetic acid, citric acid, sulfuric acid, and alkali such as sodium hydroxide are used to adjust the pH value of the conditioner. The quantity of addition of these bleach accellator and buffer agent is in a range of 0.001 to 100 g/l. A cheleting agent may be added other than these additives.

When the sensitive material used is for negatide, an aldehyde derivative may be added to the stabilizing solution to improve the presavative property of the photograph image.

To the stabilizing solution for negative, various additives may be added as required, for example, water-drop unevenness preventing agent such as siloxane derivatives, a pH adjuster such as boric acid, citric acid, phosphoric acid, and acetic acid, or sodium hydroxide, sodium acetate, and potassium citrate, film hardener such as ptash alm, and chromium alm, organic solvent such as methano, ethanol, and dimethyl sulfoxide, moisture conditioning agent such as ethylene glycol, and polyethylne glycol, and other additives for improving and extending the processing effect such as color control agent.

To elongate the counter current flow length like the above stabilizing solution, the stabilizing solution for negative may be partitioned into two or more sections. The preparation and the quantity of the replenishing solution may be the same as the above stabilizing solution.

The photo-processing waste liquid discharged after the processing has been completed may be drained in a sewage if the quantity is small, but it is preferable to give waste water treatment for environmental protection and recovery of silver.

For waste water treatment, for example, each photoprocessing solution is preferably separated and pooled by type, and concentrated and dried with water content evaporated, or filtered through or not through active carbon, ion exchange resin, silica gel, alumina, diatom earth, and coagulated with an addition of a water absorptive material. More preferably cassettified waste water treating facility or means is incorporated in the apparatus according to the invention.

[Example experiment]

(Sample disc film)

The following image forming emulsions were coated upon a transparent polyethylne terephthalate, which was cut into the same shape as a market-available disc film so as to prepare a sample disc film.

As a cartridge to contain the sample disc film, a cartridge same as a market-available one was used, wherein the sample disc film provided with a hub identical with one a market-available cartridge has was accommodated.

(Image forming emulsion)

First layer

An anti-halation layer (dry film thickness, one μm) containing black silver halide.

Second layer

A red-sensitive silver iodo-bromide emulsion layer (a silver iodo-bromide emulsion containing eight mol % of silver bromide; dry film thickness, six μm) containing, per mol of a silver halide, $6.8\times10^{-2}$ mol of 1-hydroxy-N-{⊖-(2,4-di-t-aminophenoxy) butyl}-2-naphthamide as a cyan coupler, $1.7\times10^{-2}$ mol of 1-hydroxy-N-{δ-(2,4-di-t-aminephenoxy) butyl}-4-(2-ethoxycarbonylphenylazo)-2-naphthamide as a collored coupler and $4\times10^{-3}$ mol of 2-91-phenyl-5-tetrazorylthio)-4-(2,4-di-t-amylphenoxyacetamide)-1-indanone as a development inhibiter discharging substance.

Third layer

A red-sensitive silver iodo-bromide emulsion layer (a silver iodo-bromide emulsion containing eight mol % of silver bromide; dry film thickness, six μm) containing, per mol of silver halide, $5.8\times10^{-2}$ mol 1-(2,4,6-trichloro) phynyl-3-[3-(2,4-di-t-amylphenoxy) acetamide] benzylamide-5-pyrazolone as a magenta coupler, $1.7\times10^{-2}$ mol of 1-(2,4,6-trichlorophenyl)-3-[3-(octadecenylsuccinimide)-2-chloro] anilide-4-(γ-naphthylazo)-5-pyrazolone as a collored coupler and $4\times10^{-3}$ mol of 2-(1-phenyl-5-tetrazolylthio)-4-(2,4-di-t-amylphenoxyacetamide)-1-indanone as a development inhibiter discharging substance.

Fourth layer

A green-sensitive silver iodo-bromide emulsion layer (a silver iodo-bromide emulsion containing six mol of silver iodo-bromide; dryl film thickness, 2.5 μm) containing the same compounds contained in the third layer as a magenta coupler, colored coupler and development inhibitor discharging substance, respectively at the rates, $1.1\times10^{-2}$ mol, $5\times10^{-3}$ mol and $2\times10^{-2}$ mol per mol of silver halide.

Fifth layer

A gelatin layer (dry film thickness, one μm) containing yellow colloidal silver as well as 2,4-di-to-octylhydroquinone.

Sixth layer

A blue-sensitive iodo-bromide emulsion layer (a silver iodo-bromide emulsion containing one mol % of silver iodinde; dry film thickness, six μm) containing, per mol of silver halide, 350 g of gelatin, $3\times10^{-1}$ mol α-pyvaloyl-α-(1-benzyl-2-phenyl-3,5-dioxotriazolydine-4-yl)-5'[α-(2,4-di-t-amylphenoxy) butylamide]-2' chloroacetanilide as a yellow coupler and 1,2-bis (vinylsulfony) ethane as a hardener.

Seventh layer

A gelatin layer (dry film thickness, 1 μm) containing 1,2-bis (vinylsulfonyl) ethane as a hardener and saponin as a coating auxiliary.

Eighth layer:

A protective gelatin layer (dry film thickness, 0.5 μm) containing 1,2-bis (vinylsulfonyl) ethane as a hardener, sodium di-2-ethyexylsulfosuccinate as a coating auxiliary as well as a matting agent (grain size, 1.5 μm; polymethacrylate b; 60 mg/m²).

Additionally, the ninth and tenth layers, below, were sequentially coated upon the other layers disposed on the above-mentioned polyethylene terephthalate film.

Ninth layer

A gelatin layer (dry film thickness, 6 μm) containing 1, 2-bis (vinylsulfonyl) ethane as a hardener, saponin as a coating auxiliary and the mixture of the following dyes (A) and (B) as a dye.

Dye (A)

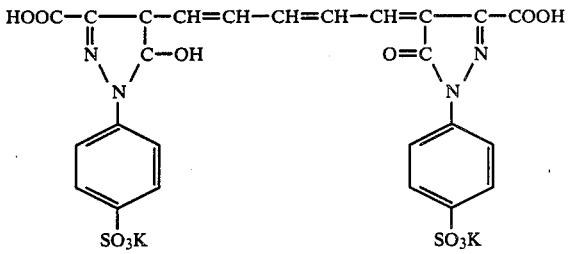

Dye (B)

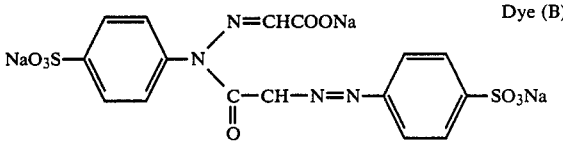

Tenth layer:

A protective gelatin layer (dry film thickness, 0.5 μm) containing 1,2-bis (vinylsulfonyl) ethane as a hardener, sodium di-2-ethylhexylsulfosuccinate as a coating auxiliary as well as a matting agent (grain size, 2.0 μm; methyl polymethacrylate b; 60 mg/m²).

(Standard processing)

After exposure, the above-mentioned disc film was removed from the cartridge and treated, in accordance with the following processes with a market-available automatic developing machine, so as to obtain standard processing data.

| Processing step | Processing temperature (°C.) | Processing time | Revolution (rpm) |
|---|---|---|---|
| 1. Color developing | 38 | 3 min 15 sec | 200 |
| 2. Bleach-fixing | 38 | 8 min | " |
| Bleaching | 38 | 6 min 30 sec | " |
| Fixing | 38 | 3 min 15 sec | " |
| 3. Rinsing | 30~34 | 2 min | " |
| 4. Stabilizing | 30~34 | 1 min | " |
| 5. Spin-squeezing | 30 | 30 sec | 2000 |
| 6. Drying | 40~60 | | 200 |

The photographic processing solutions used were as follows.

| Color developer | |
|---|---|
| Potassium carbonate | 30 g |
| Sodium sulfite | 2.5 g |
| Diethylenetriamine pentaacetic acid | 2.0 g |
| Hydroxylamine sulfate | 2.5 g |
| Sodium bromide | 1.3 g |
| Potassium hydroxide | 1.0 g |
| Color forming developing agent | 0.015 mol |

Water was added to prepaer one l solution, which was treated with 50% sulfuric acid as well as sodium hydroxide in order to attain the pH value 10.0.

| Bleach-fixer | |
|---|---|
| Ferric diethylenetriamine pentaacetate complex salt (DTPA Fe III) | 0.25 mol |
| Ammonium sulfite | 12 g |
| Ammonium thiosulfate | 150 g |
| Ammonium water (28%) | 10 ml |

Water was added to prepare one l solution, which was treated with acetic acid as well as ammonium water in order to attain the pH value 7.0.

| Stabilizer | |
|---|---|
| Formalin (35%) | 7 ml |
| 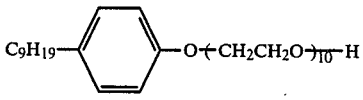 | 1.0 ml |

Water was added to prepare one l solution.

| Bleacher | |
|---|---|
| Ferric ammonium ethylenediamine tetraacetate | 100 g |
| Tetrasodium ethylenediamine tetraacetate | 2 g |
| Ammonium bromide | 160 g |

Water was added to prepare one l solution, which was treated with ammonium water and acetic acid in order to attain the pH value 6.0.

| Fixer | |
|---|---|
| Ammonium thiosulfate | 150 g |
| Ammonium sulfite | 10 g |

Water was added to prepare one l solution, which was treated with ammonium water and acetic acid in order to attain the pH value 7.0.

EXAMPLE EXPERIMENT 1

After carrying out color developing process (solution, 7 ml; solution temperature, 40° C.; processing time, 3 min 15 sec; revolution 30 rpm), bleach-fixing process (solution, 15 ml over-feeding; solution temperature, 33° C.; processing time, 6 min; revolution 30 rpm), rinsing process (solution, 50 ml; solution temperature, 30° C.; processing time, 1 min) and stabilizing process (solution, 45 ml continuous feeding; solution temperature, 33° C.; processing time 2 min 30 sec), the sample disc film was removed from the cartridge and subjected to spin squeeze (solution temperature, 30° C. processing time, 30 sec; revolution, 2000 rpm) and drying (solution temperature, 40°~60° C.; revolution, 200 rpm).

The above-mentioned processes were exercised for each of the following processing solution feeding methods.

A. The end tip of a processing solution cassette was inserted into the pin hole for driving the dark slide in order to feed the solution. During the process, the dark slide drive slot was pressed with a soft member made of rubber or the like.

B. While the dark slide drive slot was pressed with a soft member made of rubber or the like, wherein solution passage was provided on the member where the end tip of a processing solution cassette was inserted so as to feed the processing solution.

C. The dark slide for the exposure aperture was opened in order to drip-feed processing solution on the emulsion surface of the disc film.

D. The processing tank was filled with processing solution. The cartridge accommodating the sample disc film was immersed into processing solution, allowing the solution to flow into the cartridge through the openings thereof. While the process was being carried out, the cartridge was left secured and only the sample disc film was being rotated.

E. Processing solution was fed in the same manner as in D. While the processing was being carried out, the sample disc film was vertically reciprocated as accommodated in the cartridge instead of being rotated.

F. Processing solution was fed in the same manner as in D. While process was being carried out, the processing tank was vibrated instead of rotating the sample disc film.

Flaws, development blurs and Dmax resulted from each treatment, above, were examined on each emulsion surface, and, the results were as follows:

| | Flaw | Development blur | Dmax |
|---|---|---|---|
| A | Δ | o | o |
| B | Δ | o | o |
| C | o | o | o |
| D | Δ | o | o |
| E | o | o | o |
| F | o | o | Δ~o |

o means this performance item was as satisfactory as in the standard processing data. Δ means, though this item was not so good as that of the standard processing data, it caused no disadvantages in terms of photographic performance. Though slight flaws on the emulsion surface were observed on the sample disc film which was rotated as accommodated in the cartridge, such flaws were not so serious as to disadvantageously jeopardize photographic performance. As a result, it was learned that the processing with extremely low revolution compared with that of the standard processing can attain the same photographic performance.

EXAMPLE EXPERIMENT 2

G. The dark slide on the cartridge was opened and a roller was inserted through the exposure aperture in order to apply color forming developing solution on the emulsion surface, whereby the color forming developing process in example experiment 1 was carried out by modifying the processing temperature to 40° C., the processing time to 2 min 45 sec and the revolution of the disc film to 10 rpm.

H. The dark slide on the cartridge was opened and color forming developing solution was applied on the emulsion surface by spraying through the exposure aperture, whereby the color forming developing process was carried out by modifying the processing temperature to 40° C. the processing time to 3 min 15 sec and the revolution of the disc film to 10 rpm.

I. The dark slide on the cartridge was opened and processing solution in a cassette was pneumatically injected into the cartridge through the exposure aperture. After the process was complete, processing solution within the cartridge was pneumatically ejected, and, another processing solution for the next step was injected. The color developing process in example experiment 1 was carried out by modifying the processing temperature to 40° C., the processing time to 3 min 15 sec and the revolution of the disc film to 10 rpm.

EXAMPLE EXPERIMENT 3

Processing time for developing the disc film while rotating it (10 rpm) as accommodated in the cartridge was compared with the similar time for developing the film with a conventional automatic developing machine for a disc film.

In regard to color developing process with the temperature of processing solution to be supplied being 38° C., the process according to the method of the invention took 3 min, and the conventional process 3 min 15 sec, which meant there is no great difference. In bleaching process, the process according to the invention took 4 min, and the conventional process 6 min 30 sec, which posed a difference. Furthermore, in fixing process, the process according to the invention took 2 min while the conventional process 3 min 15. This meant the process according to the present invention is by far effective in rapid treatment.

EXAMPLE EXPERIMENT 4

A case where the disc film was being rotated during developing process was compared with another case where the film was not rotated during the process. At the same time, the difference due to the difference in feeding method for processing solution was tested. The results revealed that, with the method where processing solution was injected into the cartridge, three minute process by rotating the film, the processing duration was 3 min. While rotating the film, satisfactorily produced development blur-free image, and that six minute process without rotation, on the other hand, produced development blurs.

With the method where processing solution was over-fed and kept around the cartridge, 2 min 45 sec process with the rotation of the film produced no development blurs, while 6 min process without the rotation generated the blurs.

Even with the feeding method where the cartridge was immersed into processing solution so that the level of the solution is slightly above the exposure aperture, 3 min process with the rotation of the film satisfactorily produced development blur-free image, while the process without the rotation totally failed to provide such an excellent image.

Likewise, with the coating method involving sponge or the like, 2 min 30 sec process with the rotation of the film produced an excellent image, while the process without the rotation totally failed to produce such an image.

EXAMPLE EXPERIMENT 5

Next, the timing where Blue Dmax was attained, and flaw generation on the emulsion surface and the graininess were tested by varying the revolution speed of the disc film. The results are as follows.

| Revolution (rpm) | Blue Dmax | Flaws | Grainess |
|---|---|---|---|
| 1 | 3 min 45 sec | No | − |
| 10 | 3 min | No | + |
| 30 | 2 min 40 sec | No | ++ |
| 50 | 2 min 35 sec | A little | ++ |
| 100 | 2 min 30 sec | A little | ++ |

The results, above, revealed that it is possible to improve processing stability and to reduce processing time by continuously supplying flesh processing solution, and that it is advantageous in minimizing development blurs to carry out the process while rotating the disc film, and that the proper setting of revolution satisfactorily eliminates flaws. It was also learned that an agitating means to circulate processing solution is not necessary.

EXAMPLE EXPERIMENT 6

Generation of development blurs as well as flaws were compared on the following cases: the disc film exposed in steps aws processed as accommodated in the cartridge while being rotated; the film was processed as accommodated likewise without being rotated; the film was processed with a conventional automatic developing machine while being rotated; the film was processed in the similar developing machine without being rotated. When the disc film was processed with a conventional developing machine without being rotated, development blurs were generated, as a result of color developing process at 38° C. for 3 min 15 sec, though flaws did not develop. When the film was processed while being rotated with 38° C. solution temperature, 200 rpm revolution and 3 min 15 sec processing time, neither development blurs nor flaws were generated.

When the disc film was processed as accommodated in the cartridge without being rotated with 38° C. solution temperature and 4 min processing time, the results were same as those in the conventional method where disc film was being rotated. When the film was processed as accommodated in the cartridge while being rotated with 38° C. solution temperature and 3 min processing time, the results were same as those in the conventional method where the film was being rotated.

These results revealed that the processing method where a disc film is processed as accommodated in a cartridge can provide photographic performance identical to that of conventional methods, and that the method according to the invention is advantageous in reducing the processing time.

EXAMPLE EXPERIMENT 7

The disc films exposed in steps in example experiment 6 were also used, whereby a cartridge was broken after bleach-fixing were also used, process, and further processes were carried out. The results obtainable from sensitometry on this film showed that the maximum densities Dmax were as follows: regular layer, 2.9~3.0; ortho-chromatic layer, 2.2~2.3; panchromatic layer, 2.8~1.9.

EXAMPLE EXPERIMENT 8

As a method for feeding photographic processing solution into the cartridge, an immersion method, injection method to feed the solution with a cassette through openings on the cartridge, roller coating method, spraying method with a spray and injection method to feed the solution through newly prepared holes were employed to feed the solution with a temperature range 38°~40.5° C. Each sample was subjected to developing process in a lighted room by rotating the disc film at 10 rpm for 3 min, whereby developability, desilvering property, development blurs or the like of each sample were compared with those obtainable from the standard processing in a dark room with 38° C. processing solution and 3 min 15 sec processing time. As each property was comparable with that of the standard processing, and, as the emulsion surface of each sample produced no flaws, it was demonstrated that processing a disc film as accommodated in a cartridge in a lighted room is possible.

EXAMPLE EXPERIMENT 9

Each sample disc film was treated, employing 38° C. processing solution, by 3 min 15 sec color developing (CD) process, 6 min 30 sec bleaching (BL) process, 3 min 15 sec fixing (FIX) process and 4 min 30 sec stabilizing (SST) process, and by feeding processing solution into the cartridge which accommodated a disc film rotating at 30 rpm. The flaws developed on the emulsion surface were examined by removing each disc film from its cartridge at the following timings:

A. 30 sec after immersion into BL solution.
B. After completion of BL process.
C. During FIX process.
D. After completion of FIX process.
E. During SST process.
F. After completion of SST process.
G. During drying.
H. After completion of drying.

As a result:

cases A and B showed no development of flaws;

cases C and D showed minimized number of flaws, which posed no serious influence on an image plane;

cases E and F showed flaws, which did not adversely affect an image plane;

cases G and H showed serious flaws which adversely affected an image plane.

The results of the above-mentioned experiment revealed that it is most advantageous to open up a cartridge after the completion of BL process. Additionally, it was learned that the slower revolution, according to the present invention, of the disc film can provide the same effects as the revolution of the standard process.

EXAMPLE EXPERIMENT 10

In this experiment, bleach-fixing (BF) process was carried out after color developing (CD) process, unlike example experiment 9. As a result, it was learned that the opening of the cartridge after completion of bleach-fixing (BF) process is especially advantageous in terms of flaw generation on the emulsion surface. Additionally, with the above-mentioned example experiments 9 and 10, the opening means, that is, a mechanical one involving a cartridge opener and a manual one with human hands, were compared, and, no difference was found in the quality of photo-image.

EXAMPLE EXPERIMENT 11

The performance obtainable from a conventional automatic developing machine where the developing process was carried out in a dark room while rotating the disc film was compared with the performance by a method where the developing process was carried out in a lighted room while rotating the disc film in the cartridge, wherein the disc film was removed, immediately before completion of drying, from the cartridge for airdrying.

The color developing (CD) process with a conventional machine was carried out with 38° C. solution and 3 min 15 sec processing time. In the cases of color developing processes according to the invention, both 3 min process with 38° C. solution and 1 min process with 55° C. solution were carried out. The bleaching (BL), fixing (FIX) and stabilizing (SST) processes were further exercised under the same conditions for these three cases. As a result, there was no difference found in terms of development blurs, and, in regard to graininess, there neither was any difference between the result by the conventional process and that by the 3 min process at 38° C. according to the invention. Furthermore, the result by the 1 min process at 55° C. showed even better graininess than by the above-mentioned two processes.

According to such an experiment, it was revealed that the processing method according to the invention features, as a matter of course, photographic properties comparable to those obtainable from a conventional processing method and is advantageous in short-time processing, and that high temperature process is advantageous in reducing processing time and improving graininess.

EXAMPLE EXPERIMENT 12

With the photographic processing accompanying the rotation of a disc film, the experiment was carried out by disposing a drag member to cause drag in the circulating processing solution in the vicinity of the emulsion surface of a disc film and by varying the clearance between the emulsion surface and the drag member with 30 rpm revolution and 3 min 15 sec processing time, where it was assumed that the revolution was 200 rpm and Dmax 100 in the standard processing.

| Clearance (mm) | Dmax |
|---|---|
| 10 | 30 |
| 7 | 70 |
| 3 | 90 |
| 0.5 | 101 |

The results of this experiment revealed that the drag member greatly affects processability and that employment of the drag member can provide satisfactory image desity even with the low revolution of the disc film.

EXAMPLE EXPERIMENT 13

To carry out photographic processing experiment with the shown apparatuses, a container having a shape in conformity with the shown processing tank or recess was prepared using a synthetic resin such as polyethylene phthalate, wherein photographic processing solution was filled for use as a processing tank. As a result, the arrangement mentioned above, could provide the processing performance comparable to that obtainable from an arrangement where photographic solution was fed into a processing tank or recess which was prepared independently of photographic solution.

The disk film processing apparatus according to the invention makes it possible to attain the objects described above, that is, quicker processing, smaller size of apparatus, more convenient handling, easier operation, improved quality and stability of photographic performance, and smaller quantity of photographic processing solutions.

Particularly:

A. Since the disk film as being accommodated in a cartridge can be developed while being rotated, the uneven developing caused by uneven contact can be avoided, thereby preventing uneven photographic processing from taking place on and promoting processibility of the disk film.

On comparing with the case of not being rotated, it is so advantage that the processing time duration can be reduced and further the grainness of photographic property is also improved.

And, in the processing apparatus for the disk film according to the invention, it is not necessary to provide a darkroom, thereby miniaturizing the apparatus as being compact and providing it at low cost.

Accordingly, the complicated operation in the dark room, which needs a special knowledge and skill, is not required for the apparatus of the invention, thereby making the operation more easy.

B. Since light room process is permitted, any trouble can be checked by visual inspection, and security sense is given that an early trouble shooting is possible, thereby handling time can be reduced.

C. Since one-sheet-processing and two-sheet-or-more-processing can be selected as required, the size of the processing tanks and quantity of processing solutions can be set as required depending upon the number of plate disks to be processed. This reduces the quantity of processing solutions and stabilizes the process. It gives an advantage also in waste liquid disposal.

D. Since the penetration speed of the processing solution into the emulsion surface of the disk film can be accelerated, stable process and high sharpness can be attained. Further, even though the rotation of the disc film is considerably lower in the invention, stability of photographic processing and sharpness of developed image can be improved more than prior method performing to merely rotate the disk film at high speed.

And to utilize the attachement and housing member of the cartridge as the resistive member or the drag member, the present invention can fully take the advantage of minimizing the quantity of the processing solution and miniaturing the apparatus in compact size.

We claim:

1. An apparatus for processing disk film while the disk film is contained in a disk film cartridge, the disk film cartridge being adapted to be used in a disk film type camera and having an exposure aperture, a center aperture and a dark slide to slidably cover the exposure aperture, comprising:

means for holding the disk film cartridge containing the disk film therein; and means for supplying one or more processing solutions into the disk film cartridge in a pre-determined sequence.

2. An apparatus as claimed in claim 1, wherein said supplying means includes one or more tanks for containing said one or more processing solutions.

3. An apparatus as claimed in claim 2, wherein each of said one or more tanks is adapted to slidably constrain the disk film cartridge at the periphery thereof.

4. An apparatus as claimed in claim 2, further including conveying means operable to reciprocatably position the said disk film cartridge into and out of said one or more tanks.

5. An apparatus as claimed in claim 4, further including rotating means operable to rotate the disk film relative to the disk film cartridge.

6. An apparatus as claimed in claim 5, further including a resistive member adjacent the disk film operable to shear the processing solutions disposed on the disk film when said disk film rotates relative to said disk film cartridge.

7. An apparatus as claimed in claim 6, wherein said resistive member is affixed to said dark slide.

8. An apparatus as claimed in claim 2, further including means for releasing the disk film from the disk film cartridge.

9. An apparatus as claimed in claim 1, wherein said supplying means is operable to supply the one or more processing solutions into the disk film cartridge directly through the exposure aperture in the disk film cartridge.

10. An apparatus as claimed in claim 9, wherein the holding means include an open-top box enclosure adapted to removably constrain the film cartridge at the periphery thereof.

11. An apparatus as claimed in claim 10, wherein said open-top box enclosure includes a bottom having a convex shape to contain processing solutions overflowing from the disk film cartridge.

12. An apparatus as claimed in claim 10, further including rotating means operable to rotate the disk film relative to the disk film cartridge.

13. An apparatus as claimed in claim 12, wherein said supplying means includes one or more adaptors corresponding to said one or more processing solutions, said adaptors being mounted on means to move said adaptors relative to the exposure aperture in the disk film cartridge and said adaptors containing and conveying said one or more processing solutions to said disk film cartridge and delivering said solutions to the exposure aperture in the disk film cartridge.

14. An apparatus as claimed in claim 13, wherein said one or more adaptors each include shearing means for shearing the processing solutions disposed on the disk film when said disk film rotates relative to the disk film cartridge.

15. An apparatus as claimed in claim 9, further including means for sliding the dark slide to uncover the exposure aperture.

16. An apparatus as claimed in claim 1, further including means for drying the disk film.

17. A method for processing disk film while the disk film is contained in a disk film cartridge, the disk film cartridge being adapted for use in a disk film type camera and having an exposure aperture, a center aperture and a dark slide to slidably cover the exposure aperture, comprising:

holding a disk film cartridge containing a disk film therein; and supplying one or more processing solutions into the disk film cartridge in a pre-determined sequence.

18. A method as claimed in claim 17, wherein said supplying step includes dipping the disk cartridge into one or more tanks containing said one or more processing solutions.

19. A method as claimed in claim 17, wherein said supplying step includes supplying said one or more processing solutions directly through the exposure aperture individually in said pre-determined sequence.

20. A method as claimed in claim 18, further including the step of rotating the disk film relative to the disk film cartridge at least during the time that said one or more processing solutions is supplied to the disk cartridge.

21. A method as claimed in claim 10, further including the step of rotating the disk film relative to the disk film cartridge at least during the time that said one or more processing solutions is supplied to the disk cartridge.

* * * * *